US009417590B2

(12) United States Patent
Habu

(10) Patent No.: US 9,417,590 B2
(45) Date of Patent: Aug. 16, 2016

(54) PRINTING CONTROL DEVICE, PRINTING CONTROL METHOD, AND COMPUTER-READABLE STORAGE MEDIUM FOR GLOSS CONTROL DURING POST-PROCESSING

(71) Applicant: Yuichi Habu, Ibaraki (JP)

(72) Inventor: Yuichi Habu, Ibaraki (JP)

(73) Assignee: RICOH COMPANY, LTD., Tokyo (JP)

( * ) Notice: Subject to any disclaimer, the term of this patent is extended or adjusted under 35 U.S.C. 154(b) by 75 days.

(21) Appl. No.: 13/859,141

(22) Filed: Apr. 9, 2013

(65) Prior Publication Data

US 2013/0272765 A1 Oct. 17, 2013

(30) Foreign Application Priority Data

Apr. 11, 2012 (JP) ..... 2012-090581
Mar. 22, 2013 (JP) ..... 2013-060902

(51) Int. Cl.
*G03G 15/00* (2006.01)

(52) U.S. Cl.
CPC .... *G03G 15/6585* (2013.01); *G03G 2215/0081* (2013.01); *G03G 2215/00805* (2013.01)

(58) Field of Classification Search
CPC ..... G03G 15/6585; G03G 2215/00805; G03G 2215/0081
USPC ..... 399/341, 407; 358/1.6, 1.9, 2.1; 427/494
See application file for complete search history.

(56) References Cited

U.S. PATENT DOCUMENTS

| | | | | |
|---|---|---|---|---|
| 2009/0034998 | A1 | 2/2009 | Omata | |
| 2009/0207429 | A1 | 8/2009 | Iguchi | |
| 2011/0076073 | A1* | 3/2011 | Omata | 399/341 |
| 2011/0206429 | A1 | 8/2011 | Terao et al. | |
| 2012/0063802 | A1 | 3/2012 | Suzuki et al. | |
| 2012/0237247 | A1* | 9/2012 | Tokushima | G03G 15/6585 399/82 |
| 2013/0016378 | A1 | 1/2013 | Iguchi | |

FOREIGN PATENT DOCUMENTS

| | | |
|---|---|---|
| JP | 2009-058941 | 3/2009 |
| JP | 2009-190336 | 8/2009 |
| JP | 2010-152129 | 7/2010 |
| JP | 2011-180391 | 9/2011 |
| JP | 2012-083736 | 4/2012 |

* cited by examiner

*Primary Examiner* — Matthew G Marini
*Assistant Examiner* — Quang X Nguyen
(74) *Attorney, Agent, or Firm* — Oblon, McClelland, Maier & Neustadt, L.L.P

(57) ABSTRACT

A printing control device includes a data acquiring unit configured to acquire gloss-control plane data that indicates a plurality of types of surface effects to be applied to one page of a recording medium and areas to which the respective types of surface effects are to be applied in the one page of the recording medium. The types of surface effects correspond respectively to a plurality of types of post-processing that are incapable of being simultaneously performed on the one page of the recording medium by a post-processing device that performs post-processing for a clear toner transferred onto the recording medium. The printing control device also includes a determining unit configured to determine one of the types of post-processing to be preferentially performed on the one page of the recording medium, based on priority information that indicates which type of post-processing is to be preferentially performed.

8 Claims, 18 Drawing Sheets

| NAME OF GLOSS CONTROL | GLOSSINESS | DEVIATION |
|---|---|---|
| PREMIUM GLOSS | Gs≥80 | ΔGs≤10 |
| GLOSS | Gs=Gs (SOLID GLOSSY) | ΔGs≤10 |
| MATTE | Gs=Gs (1C 30% HALFTONE DOTS) | ΔGs≤10 |
| PREMIUM MATTE | Gs≤10 | ΔGs≤10 |

| TYPE OF SURFACE EFFECT SPECIFIED BY USER | DENSITY VALUE OF GLOSS-CONTROL PLANE [%] |
|---|---|
| PG | 98% |
| G | 90% |
| M | 16% |
| PM | 6% |

FIG.12

| DENSITY [%] | DENSITY (PIXEL VALUE) | | | EFFECT | CLEAR-TONER PLANE | GLOSSER ON/OFF |
|---|---|---|---|---|---|---|
| | REPRESENTATIVE VALUE | VALUE RANGE | | | | |
| 98% | 250 | 248 | 255 | PREMIUM GLOSS TYPE A | INVERSE MASK A | ON |
| 96% | 245 | 243 | 247 | PREMIUM GLOSS TYPE B | INVERSE MASK B | ON |
| 94% | 240 | 238 | 242 | PREMIUM GLOSS TYPE C | INVERSE MASK C | ON |
| 92% | 235 | 233 | 237 | RESERVED | - | - |
| 90% | 230 | 228 | 232 | GLOSS TYPE 1 | INVERSE MASK 1 | OFF |
| 88% | 224 | 222 | 227 | GLOSS TYPE 2 | INVERSE MASK 2 | OFF |
| 86% | 219 | 217 | 231 | GLOSS TYPE 3 | INVERSE MASK 3 | OFF |
| 84% | 214 | 212 | 216 | GLOSS TYPE 4 | INVERSE MASK 4 | OFF |
| 82% | 209 | 207 | 211 | RESERVED | - | - |
| 54% | 138 | 136 | 140 | USER DEFINITION 03 | (CREATED BY USER) | (DON'T CARE) |
| 52% | 133 | 131 | 135 | USER DEFINITION 02 | (CREATED BY USER) | (DON'T CARE) |
| 50% | 128 | 126 | 130 | USER DEFINITION 01 | (CREATED BY USER) | (DON'T CARE) |
| 48% | 122 | 120 | 125 | RESERVED | - | - |
| 46% | 117 | 115 | 119 | RESERVED | - | - |
| 44% | 112 | 110 | 114 | WATERMARK CHARACTER 3 (CONFIDENTIAL) | TILE CHARACTER STRING 3 | (DON'T CARE) |
| 42% | 107 | 105 | 109 | WATERMARK CHARACTER 2 (COPYING IS STRICTLY PROHIBITED) | TILE CHARACTER STRING 2 | (DON'T CARE) |
| 40% | 102 | 100 | 104 | WATERMARK CHARACTER 1 (SAMPLE) | TILE CHARACTER STRING 1 | (DON'T CARE) |
| 38% | 97 | 95 | 99 | RESERVED | - | - |
| 36% | 92 | 90 | 94 | RESERVED | - | - |
| 34% | 87 | 85 | 89 | BACKGROUND PATTERN 3 (STAR) | TILE BACKGROUND PATTERN 3 | (DON'T CARE) |
| 32% | 82 | 80 | 84 | BACKGROUND PATTERN 2 (CHECK) | TILE BACKGROUND PATTERN 2 | (DON'T CARE) |
| 30% | 76 | 74 | 79 | BACKGROUND PATTERN 1 (WAVE) | TILE BACKGROUND PATTERN 1 | (DON'T CARE) |
| 28% | 71 | 69 | 73 | RESERVED | - | - |
| 26% | 66 | 64 | 68 | RESERVED | - | - |
| 24% | 61 | 59 | 63 | TACTILE PATTERN TYPE 3 (COARSE) | TILE MESH PATTERN 3 | OFF |
| 22% | 56 | 54 | 58 | TACTILE PATTERN TYPE 2 (MIDDLE) | TILE MESH PATTERN 2 | OFF |
| 20% | 51 | 49 | 53 | TACTILE PATTERN TYPE 1 (FINE) | TILE MESH PATTERN 1 | OFF |
| 18% | 46 | 44 | 48 | RESERVED | - | - |
| 16% | 41 | 39 | 43 | MATTE TYPE 4 | TILE HALFTONE DOTS 4 | OFF |
| 14% | 36 | 34 | 38 | MATTE TYPE 3 | TILE HALFTONE DOTS 3 | OFF |
| 12% | 31 | 29 | 33 | MATTE TYPE 2 | TILE HALFTONE DOTS 2 | OFF |
| 10% | 25 | 23 | 28 | MATTE TYPE 1 | TILE HALFTONE DOTS 1 | OFF |
| 8% | 20 | 18 | 22 | RESERVED | - | - |
| 0% | 0 | 0 | 0 | NONE | (NO DATA) | (DON'T CARE) |

FIG.15

| EFFECT | PRESENCE OR ABSENCE |
|---|---|
| PREMIUM GLOSS TYPE A | PRESENT |
| PREMIUM GLOSS TYPE B | ABSENT |
| PREMIUM GLOSS TYPE C | ABSENT |
| GLOSS TYPE 1 | ABSENT |
| GLOSS TYPE 2 | ABSENT |
| GLOSS TYPE 3 | ABSENT |
| GLOSS TYPE 4 | ABSENT |
| USER DEFINITION 03 | ABSENT |
| USER DEFINITION 02 | ABSENT |
| USER DEFINITION 01 | ABSENT |
| WATERMARK CHARACTER 3 (CONFIDENTIAL) | ABSENT |
| WATERMARK CHARACTER 2 (COPYING IS STRICTLY PROHIBITED) | ABSENT |
| WATERMARK CHARACTER 1 (SAMPLE) | ABSENT |
| BACKGROUND PATTERN 3 (STAR) | ABSENT |
| BACKGROUND PATTERN 2 (CHECK) | ABSENT |
| BACKGROUND PATTERN 1 (WAVE) | ABSENT |
| TACTILE PATTERN TYPE 3 (COARSE) | ABSENT |
| TACTILE PATTERN TYPE 2 (MIDDLE) | PRESENT |
| TACTILE PATTERN TYPE 1 (FINE) | ABSENT |
| MATTE TYPE 4 | ABSENT |
| MATTE TYPE 3 | ABSENT |
| MATTE TYPE 2 | ABSENT |
| MATTE TYPE 1 | PRESENT |
| ⋮ | ⋮ |
| CLEAR PLANE | PRESENT/ ABSENT |

FIG.19

SETTING>SYSTEM SETTING>
POST-PROCESSING CONTROL PARAMETER

| | |
|---|---|
| PREMIUM GLOSS | ◎ON ○OFF ○DEFAULT |
| GLOSS | ○ON ◎OFF ○DEFAULT |
| WATERMARK CHARACTER | ○ON ○OFF ◎DEFAULT |
| BACKGROUND PATTERN | ○ON ○OFF ◎DEFAULT |
| TACTILE PATTERN | ○ON ◎OFF ○DEFAULT |
| MATTE | ○ON ◎OFF ○DEFAULT |
| USER DEFINITION 01 | ○ON ○OFF ◎DEFAULT |
| USER DEFINITION 02 | ○ON ○OFF ◎DEFAULT |
| USER DEFINITION 03 | ○ON ○OFF ◎DEFAULT |
| CLEAR PLANE | ○ON ○OFF ◎DEFAULT |

OK CANCEL

PRINTING CONTROL DEVICE, PRINTING CONTROL METHOD, AND COMPUTER-READABLE STORAGE MEDIUM FOR GLOSS CONTROL DURING POST-PROCESSING

CROSS-REFERENCE TO RELATED APPLICATIONS

The present application claims priority to and incorporates by reference the entire contents of Japanese Patent Application No. 2012-090581 filed in Japan on Apr. 11, 2012 and Japanese Patent Application No. 2013-060902 filed in Japan on Mar. 22, 2013.

BACKGROUND OF THE INVENTION

1. Field of the Invention

The present invention relates to a printing control device, a printing control method, and a computer-readable storage medium.

2. Description of the Related Art

Conventionally, there have been developed image forming apparatuses provided with a clear toner, which is a colorless toner including no color material in addition to four color toners of CMYK. A toner image formed with such a clear toner is fixed on a recording medium, such as a transfer sheet, on which an image is formed with CMYK toners. As a result, a visual effect and a tactile effect (referred to as a surface effect) are produced on the surface of the recording medium. The surface effect to be produced differs depending on the type of the toner image formed with the clear toner and the way to fix the toner image. Some surface effects simply provide gloss, whereas some surface effects suppress gloss. Other examples of the surface effects may include: a surface effect applied not to the entire surface but to a part thereof; a surface effect that forms a texture and a watermark with a clear toner; a surface effect that provides surface protection; and a surface effect produced by a dedicated post-processing device, such as a glosser and a low-temperature fixing device, performing post-processing besides by fixing control. Japanese Patent Application Laid-open No. 2009-058941, for example, discloses an image forming apparatus that can change forming conditions for forming a latent image of a transparent toner image.

Japanese Patent Application Laid-open No. 2010-152129, for example, discloses an image forming apparatus that performs control such that the frequency of fixing processing related to an electrophotography process differs for a divided image divided into a plurality of parts in units in which the level of gloss is to be changed.

If a print request is received in which a plurality of surface effects to be produced by a plurality of types of post-processing are present in a single page and if the post-processing device cannot perform the types of post-processing simultaneously in the single page, the conventional image forming apparatus cannot control the post-processing device so as to produce the surface effects properly.

Therefore, there is a need to provide a printing control device, a printing control method, and a computer-readable storage medium that can accept a print request including a plurality of surface effects to be produced by a plurality of types of post-processing incapable of being performed simultaneously by a post-processing device in a single page and control the post-processing device so as to produce the surface effects properly.

SUMMARY OF THE INVENTION

It is an object of the present invention to at least partially solve the problems in the conventional technology.

According to an embodiment, there is provided a printing control device that includes a data acquiring unit configured to acquire gloss-control plane data that indicates a plurality of types of surface effects to be applied to one page of a recording medium and areas to which the respective types of surface effects are to be applied in the one page of the recording medium. The types of surface effects correspond respectively to a plurality of types of post-processing that are incapable of being simultaneously performed on the one page of the recording medium by a post-processing device that performs post-processing for a clear toner transferred onto the recording medium. The printing control device also includes a determining unit configured to determine one of the types of post-processing to be preferentially performed on the one page of the recording medium, based on priority information that indicates which type of post-processing is to be preferentially performed.

According to another embodiment, there is provided a printing control method that includes acquiring gloss-control plane data that indicates a plurality of types of surface effects to be applied to one page of a recording medium and areas to which the respective types of surface effects are to be applied in the one page of the recording medium, the types of surface effects corresponding respectively to a plurality of types of post-processing that are incapable of being simultaneously performed on the one page of the recording medium by a post-processing device that performs post-processing for a clear toner transferred onto the recording medium; and determining one of the types of post-processing to be preferentially performed on the one page of the recording medium, based on priority information that indicates which type of post-processing is to be preferentially performed.

According to still another embodiment, there is provided a non-transitory computer-readable storage medium with an executable program stored thereon. The program instructs a computer to perform acquiring gloss-control plane data that indicates a plurality of types of surface effects to be applied to one page of a recording medium and areas to which the respective types of surface effects are to be applied in the one page of the recording medium, the types of surface effects corresponding respectively to a plurality of types of post-processing that are incapable of being simultaneously performed on the one page of the recording medium by a post-processing device that performs post-processing for a clear toner transferred onto the recording medium; and determining one of the types of post-processing to be preferentially performed on the one page of the recording medium, based on priority information that indicates which type of post-processing is to be preferentially performed.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 12 is an exemplary schematic of a data structure of a surface effect selection table;

FIG. 15 is a schematic of an example of a list (results of acquisition of surface effect information) to which the clear-toner plane processing unit adds a surface effect of the gloss-control plane;

FIG. 19 is a schematic of a menu screen used for changing the surface effect selection table displayed by a UI;

DETAILED DESCRIPTION OF THE PREFERRED EMBODIMENTS

Exemplary embodiments of a device, a system, a method, and a computer program for controlling printing according to the present invention are described below in greater detail with reference to the accompanying drawings.

First Embodiment

Figure 1:
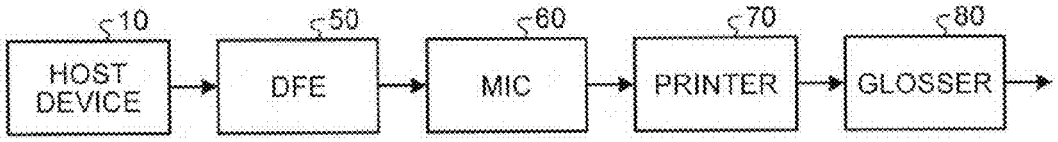
FIG. 1 is an exemplary block diagram of a configuration of a printing control system according to a first embodiment of the present invention.

A configuration of a printing control system (an image forming system) according to a first embodiment of the present invention will be described with reference to FIG. 1. The printing control system according to the present embodiment includes a printing control device (digital front end: DFE) 50 (hereinafter, referred to as a "DFE 50"), an interface controller (mechanism I/F controller: MIC) 60 (hereinafter, referred to as an "MIC 60"), a printer 70, and a glosser 80 serving as a post-processing device connected in series. The DFE 50 communicates with the printer 70 via the MIC 60 and controls formation of an image in the printer 70. Furthermore, the DFE 50 is connected to a host device 10, such as a personal computer (PC), and receives image data from the host device 10. The DFE 50 uses the image data to generate image data used for forming toner images corresponding to CMYK toners and a clear toner by the printer 70. The DFE 50 then transmits the image data thus generated to the printer 70 via the MIC 60. The printer 70 is provided with at least CMYK toners and a clear toner. The printer 70 is further provided with an image forming unit including a photosensitive element, a charger, a developing unit, and a photosensitive-element cleaning unit, an exposing unit, and a fixing unit for each toner.

The clear toner is a transparent (colorless) toner including no color material. Being transparent (colorless) means that the transmittance is equal to or larger than 70%, for example.

The printer 70 outputs a light beam from the exposing unit correspondingly to image data transmitted from the DFE 50 via the MIC 60 to form a toner image corresponding to each toner on the photosensitive element. The printer 70 then transfers the toner image onto a sheet serving as a recording medium and fixes the toner image thereon at temperature within a predetermined range (normal temperature) and pressure by the fixing unit. Thus, an image is formed on the sheet. The sheet is given just as an example of the recording medium, and the recording medium is not limited thereto. The recording medium may be a piece of synthetic paper or a piece of plastic paper, for example.

The glosser 80 is controlled to be turned ON or OFF in accordance with ON-OFF information specified by the DFE 50. If the glosser 80 is turned ON, the glosser 80 presses an image formed on a sheet by the printer 70 at high temperature and high pressure. Subsequently, the glosser 80 cools the sheet on which the image is formed and removes the sheet from its main body. This operation evenly compresses the total amount of adhered toners on pixels to which a toner of equal to or larger than a predetermined amount is adhered in the whole image formed on the sheet. In other words, the glosser 80 performs post-processing for applying a surface effect in page units.

The image data (document data) received from the host device 10 will now be described. In the host device 10, image data is generated by an image processing application (an image processing unit 120, a plane data generating unit 122, a print data generating unit 123, and other units, which will be described later) installed in advance and is transmitted to the DFE 50. Such an image processing application can deal with image data of a specific color plane in contrast to image data that specifies a value of density (referred to as a density value) of each color in each color plane, such as an RGB plane and a CMYK plane, for each pixel. The specific color plane is image data used for adhering a toner and an ink of a specific color, such as white, gold, and silver, in addition to basic colors, such as CMYK and RGB. The specific color plane is data used by a printer provided with a toner and an ink of such a specific color. To improve the color reproducibility, R may be added to the basic colors of CMYK or Y may be added to the basic colors of RGB in the specific color plane. Typically, a clear toner has been considered as one of the specific colors.

In the present embodiment, the clear toner serving as a specific color is used to form a surface effect, which is a visual or tactile effect to be applied to a sheet, and to form a transparent image, such as a watermark and a texture, other than the surface effect described above.

Therefore, in addition to image data of a color plane, the image processing application of the host device 10 generates at least one of image data of a gloss-control plane and image data of a clear plane as image data of a specific color plane in accordance with a user's specification from the image data thus received.

Figure 2:
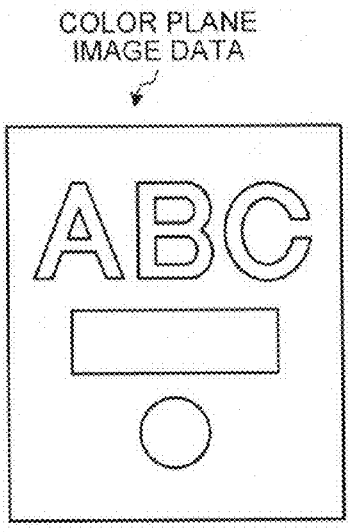
FIG. 2 is a schematic of an example of color plane image data.

The image data of the color plane is image data that specifies the density value of a color of RGB and CMYK for each pixel, for example. In the image data of the color plane, one pixel is represented by 8-bits in accordance with the user's specification of a color. FIG. 2 is a view for explaining an example of the image data of the color plane. In FIG. 2, a density value corresponding to a color specified by the user via the image processing application is defined for each drawn object, such as "A", "B", and "C".

The image data of the gloss-control plane is image data used to perform control for adhering the clear toner correspondingly to a surface effect, which is a visual or tactile effect applied to a sheet, and specifies an area to which the surface effect is to be applied and the type of the surface effect.

Similarly to the color plane of RGB and CMYK, for example, each pixel in the gloss-control plane is represented by 8-bits with a density value ranging from "0" to "255". The density values are associated with the types of surface effects (the density values may be represented by 16-bits or 32-bits or by 0 to 100%). The same value is set for areas to which the same surface effect is desired to be applied regardless of the density of the clear toner to be actually adhered. Therefore, even if there is no data indicating the areas, the areas can be readily specified from the image data as needed. In other words, the gloss-control plane indicates the type of a surface effect and the area to which the surface effect is to be applied (data indicating the area may be provided separately).

The host device 10 sets the type of a surface effect for a drawn object specified by the user via the image processing application as a density value serving as a gloss-control value for each drawn object, thereby generating image data of the gloss-control plane (gloss-control plane image data) in a vector format.

Each pixel constituting the image data of the gloss-control plane corresponds to each pixel in the image data of the color plane. The density value of each pixel corresponds to the pixel value in each image data. Both the image data of the color plane and the image data of the gloss-control plane are formed in page units.

Figures 3, 4:
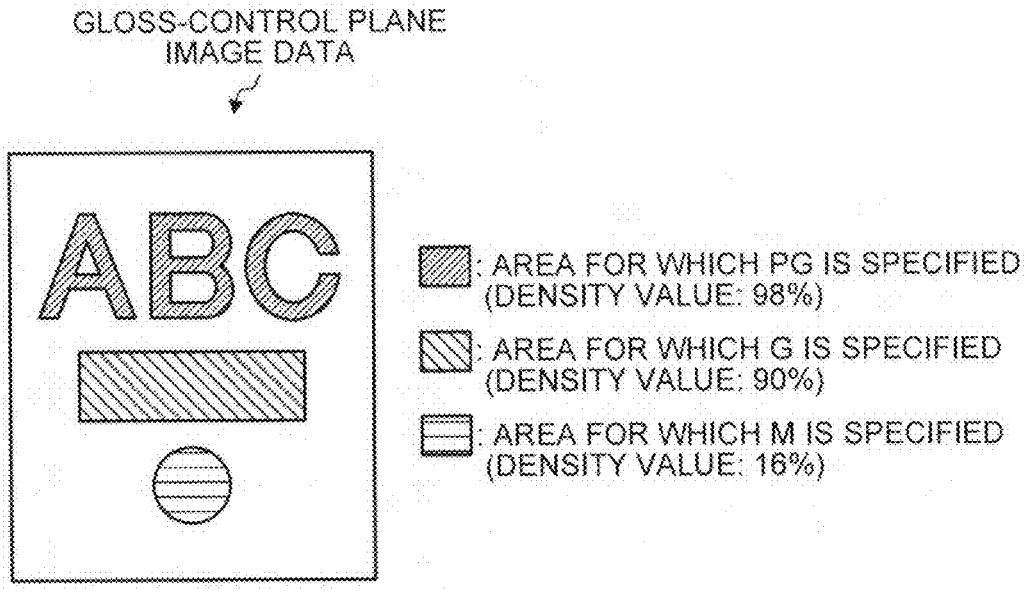
FIG. 3 is an exemplary schematic of the types of surface effects related to the presence of gloss.
FIG. 4 is a schematic illustrating gloss-control plane image data as an image.

The types of surface effects are roughly classified into a surface effect related to the presence of gloss, surface protection, a watermark indicating information, and a texture, for example. The surface effects related to the presence of gloss are roughly classified into four as illustrated in FIG. 3. The four types of surface effects are mirror-surface glossy (PG: Premium Gloss), solid glossy (G: Gloss), halftone matte (M: Matte), and delustered (PM: Premium Matte) in descending order of degrees of gloss (glossiness), for example. Hereinafter, the mirror-surface glossy, the solid glossy, the halftone matte, and the delustered may be referred to as premium gloss (PG), gloss (G), matte (M), and premium matte (PM), respectively.

Premium gloss and gloss provide a higher gloss, whereas matte and premium matte suppress gloss. In particular, premium matte provides glossiness lower than that of plain paper. In FIG. 3, premium gloss indicates glossiness Gs of equal to or higher than 80, gloss indicates solid glossiness in a primary color or a secondary color, matte indicates glossiness in a primary color and halftone dots of 30%, and premium matte indicates glossiness of equal to or lower than 10. The deviation in the glossiness is represented by AGs and is equal to or smaller than 10. For these types of surface effects, a higher density value is associated with a surface effect that provides a higher gloss, whereas a lower density value is associated with a surface effect that suppresses gloss. A density value in the middle thereof is associated with a surface effect, such as a watermark and a texture. Examples of the watermark may include a character and a background pattern. The texture is formed of characters and patterns and can produce a tactile effect besides a visual effect. A pattern of a stained glass can be formed with the clear toner, for example. Premium gloss and gloss also serve as surface protection. The user specifies the area to which the surface effect is to be applied in an image represented by image data to be processed and the type of the surface effect to be applied to the area via the image processing application. The host device 10 that exerts the image processing application sets a density value corresponding to the surface effect specified by the user for the drawn object corresponding to the area specified by the user, thereby generating image data of the gloss-control plane. The correspondence relation between the density values and the types of surface effects will be described later in detail.

FIG. 4 is a view for explaining an example of the image data of the gloss-control plane. In the example of the gloss-control plane in FIG. 4, the user applies the surface effect "premium gloss (PG)" to a drawn object of "ABC", applies the surface effect "gloss (G)" to a drawn object of "a rectangular figure", and applies the surface effect "matte (M)" to a drawn object of "a circular figure". The density value set for each surface effect is a density value defined correspondingly to the type of each surface effect in a density value selection table (refer to FIG. 9), which will be described later.

Figure 5:
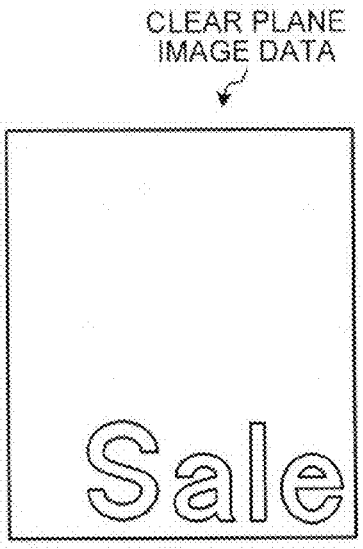
FIG. 5 is a schematic of an example of clear plane image data.

The image data of the clear plane is image data specifying a transparent image, such as a watermark and a texture, other than the surface effects described above. FIG. 5 is a view for explaining an example of the image data of the clear plane. In the example of FIG. 5, the user specifies a watermark "Sale".

As described above, the image data of the gloss-control plane and the clear plane, which is image data of the specific color plane, is generated as planes different from that of the image data of the color plane by the image processing application of the host device 10. The image data of the color plane, the image data of the gloss-control plane, and the image data of the clear plane are generated in a portable document format (PDF). These pieces of image data of the planes in the PDF are integrated and generated as document data. The data format of the image data of each plane is not limited to the PDF and may be an arbitrary format.

Figure 6:
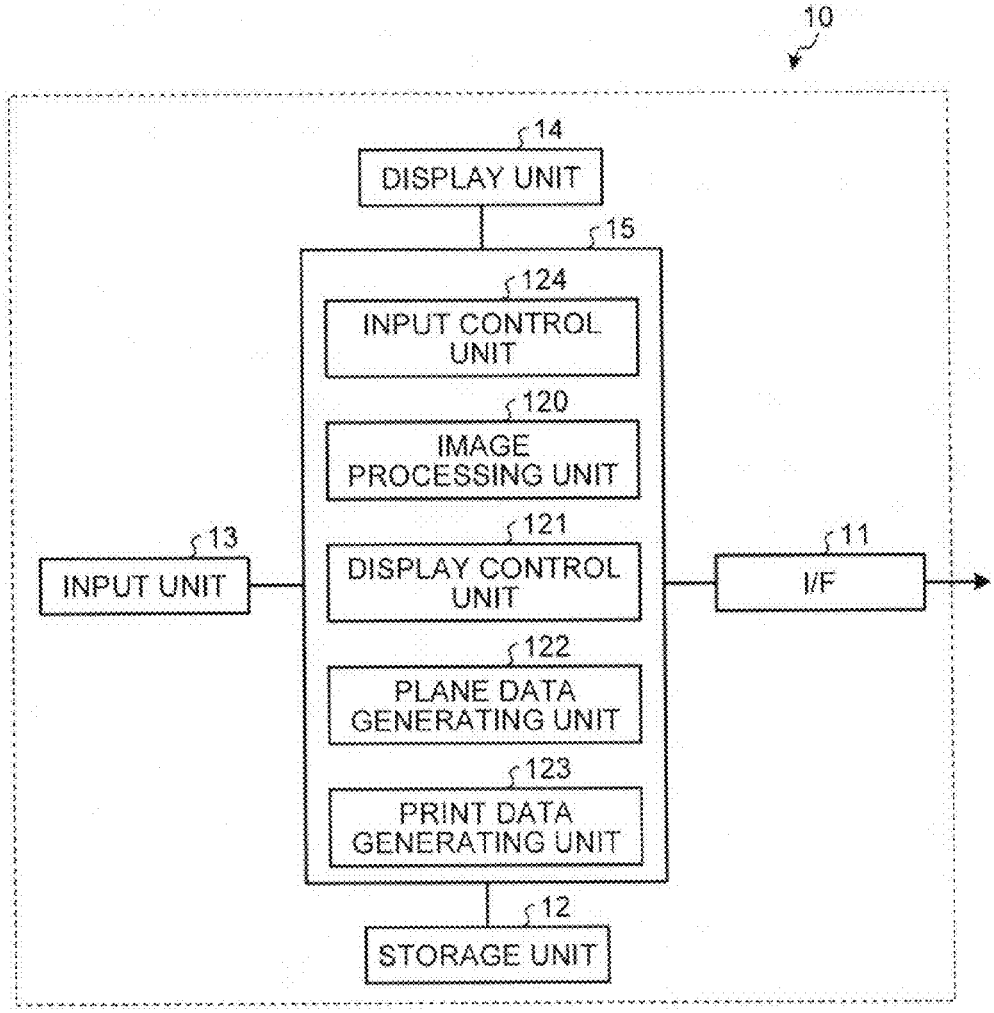
FIG. 6 is a block diagram of an exemplary schematic configuration of a host device.

The host device 10 that generates the image data of each plane will now be described in detail. FIG. 6 is a block diagram of an exemplary schematic configuration of the host device 10. As illustrated in FIG. 6, the host device 10 includes an I/F 11, a storage unit 12, an input unit 13, a display unit 14, and a control unit 15. The I/F 11 is an interface device that communicates with the DFE 50. The storage unit 12 is a storage medium, such as a hard disk drive (HDD) and a memory, that stores therein various types of data. The input unit 13 is an input device through which the user performs various input operations and is formed of a keyboard and a mouse, for example. The display unit 14 is a display device that displays various screens and is formed of a liquid crystal panel, for example.

The control unit 15 is a computer collectively controlling the host device 10 and including a central processing unit (CPU), a read-only memory (ROM), and a random access memory (RAM), for example. As illustrated in FIG. 6, the control unit 15 mainly includes an input control unit 124, the image processing unit 120, a display control unit 121, the plane data generating unit 122, and the print data generating unit 123. The input control unit 124 and the display control unit 121 among these units are executed by the CPU of the control unit 15 reading a computer program of an operating system stored in the ROM or the like and loading and executing the computer program on the RAM. The image processing unit 120, the plane data generating unit 122, and the print data generating unit 123 are executed by the CPU of the control unit 15 reading a computer program of the image processing application stored in the ROM or the like and loading and executing the computer program on the RAM. The plane data generating unit 122 is provided as a plug-in function installed in the image processing application, for example. At least a part of these units may be executed by an individual circuit (hardware).

The input control unit 124 receives various types of input from the input unit 13 and controls the input. By operating the input unit 13, for example, the user can input image specification information for specifying an image to which a surface effect is to be applied, that is, image data of the color plane (hereinafter, it may be referred to as a "target image") among various images (e.g., photos, characters, figures, and images obtained by synthesizing these elements) stored in the storage unit 12. The method for inputting the image specification information is not limited thereto, and an arbitrary method may be employed.

The display control unit 121 controls display of various types of information on the display unit 14. In the present embodiment, if the input control unit 124 receives image specification information, the display control unit 121 reads an image specified by the image specification information from the storage unit 12 and controls the display unit 14 to display the image thus read on the screen.

By operating the input unit 13 while checking the target image displayed on the display unit 14, the user can input specification information for specifying an area to which a surface effect is to be applied and the type of the surface effect. The method for inputting the specification information is not limited thereto, and an arbitrary method may be employed.

Figure 7:
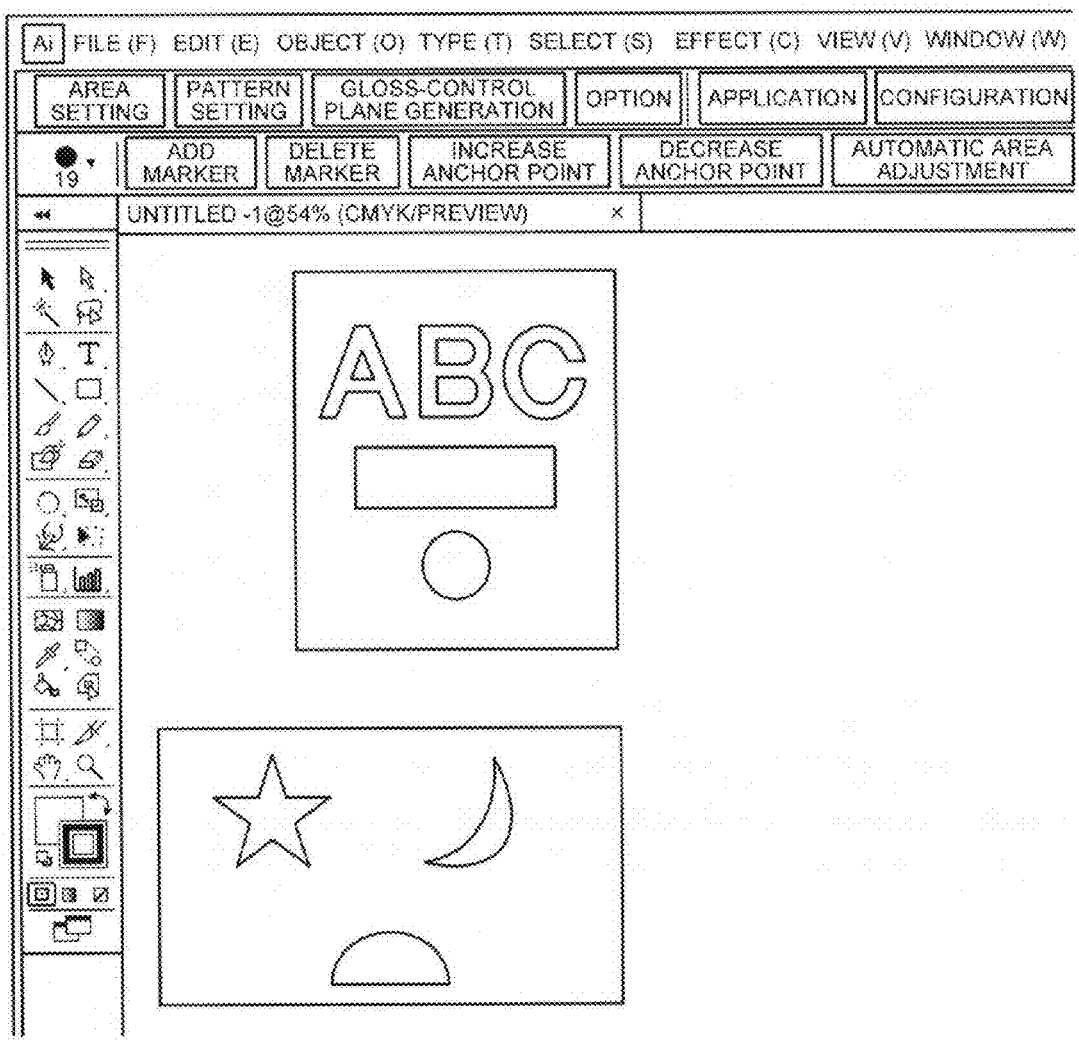
FIG. 7 is a schematic of an exemplary screen displayed by an image processing application.
Figure 8:
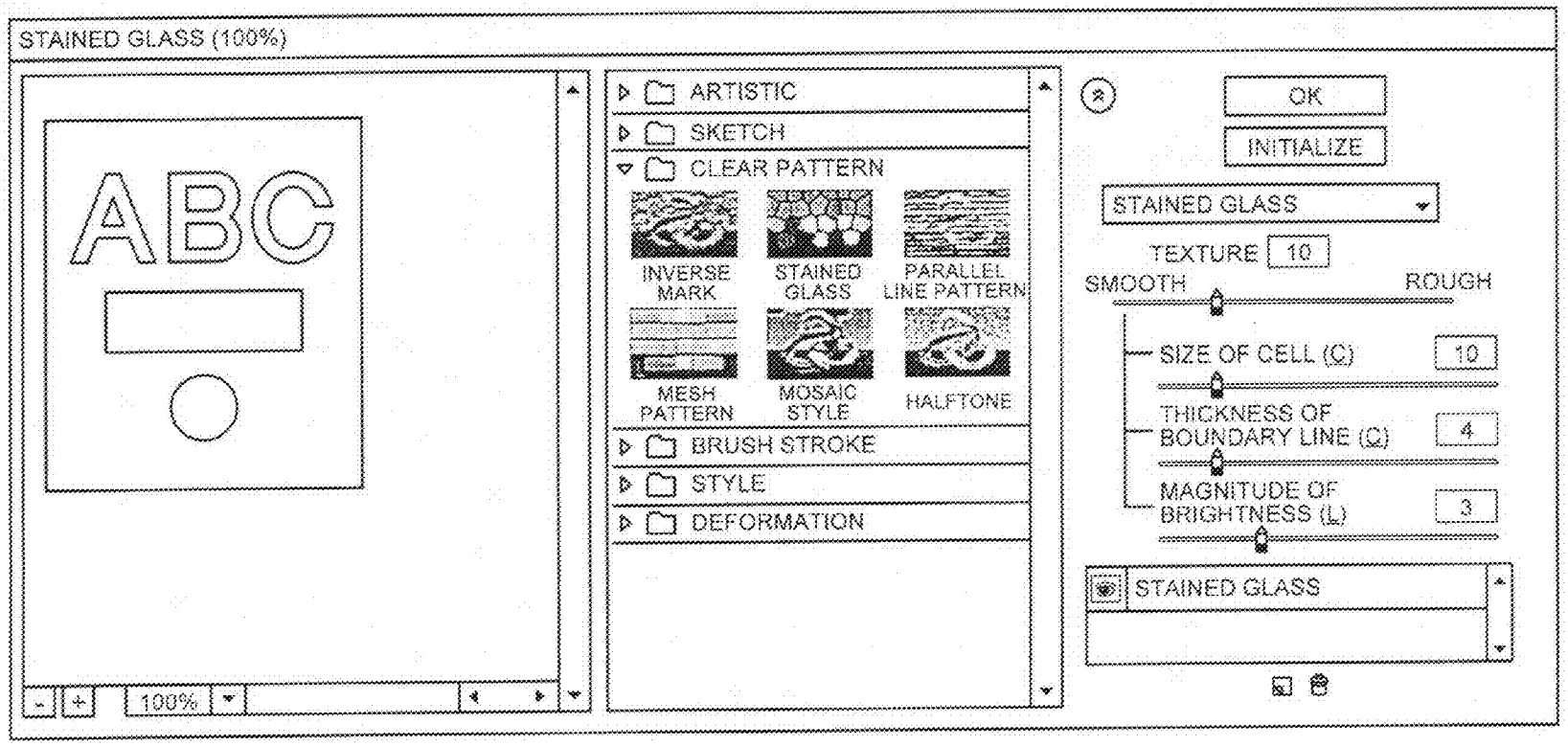
FIG. 8 is a schematic of another exemplary screen displayed by the image processing application.

More specifically, the display control unit 121 causes the display unit 14 to display a screen illustrated in FIG. 7, for example. FIG. 7 is an example of a screen displayed when a plug-in is incorporated into Illustrator (registered trademark) marketed by Adobe Systems (R). The screen illustrated in FIG. 7 displays an image indicated by target image data (image data of the color plane) to be processed. If the user presses a marker add button through the input unit 13 to perform an input operation for specifying an area to which a surface effect is desired to be applied, the area to which the surface effect is to be applied is specified. The user performs such an input operation on all the areas to which a surface effect is to be applied. The display control unit 121 of the host device 10 then causes the display unit 14 to display a screen illustrated in FIG. 8 for each area thus specified, for example. The screen illustrated in FIG. 8 displays an image of each area specified as an area to which a surface effect is to be applied. If the user performs an input operation for specifying the type of the surface effect desired to be applied to the image through the input unit 13, the type of the surface effect to be applied to the area is specified. The types of surface effects of premium gloss and gloss illustrated in FIG. 3 are denoted as "inverse mask" in FIG. 8. The effects other than premium gloss and gloss illustrated in FIG. 3 are denoted as stained glass, parallel line pattern, mesh pattern, mosaic style, matte, and halftone in FIG. 8. Thus, the screen indicates that each surface effect can be specified.

Referring back to FIG. 6, the image processing unit 120 performs various types of image processing on the target image based on an instruction received from the user through the input unit 13.

The plane data generating unit 122 generates image data of the color plane, image data of the gloss-control plane, and image data of the clear plane. In other words, if the input control unit 124 receives specification of a color made by the user for a drawn object of a target image, the plane data generating unit 122 generates image data of the color plane in accordance with the specification of a color.

If the input control unit 124 receives specification of a transparent image other than the surface effect, such as a watermark and a texture, and of an area in which the transparent image is to be formed, the plane data generating unit 122 generates image data of the clear plane for specifying the transparent image and the area in which the transparent image is to be formed on a sheet in accordance with the specification made by the user.

If the input control unit 124 receives specification information (an area to which a surface effect is to be applied and the type of the surface effect), the plane data generating unit 122 generates image data of the gloss-control plane capable of specifying the area to which the surface effect is to be applied on a sheet and the type of the surface effect based on the specification information. The plane data generating unit 122 generates image data of the gloss-control plane for specifying the area to which the surface effect represented by a gloss-control value is to be applied in units of drawn objects in the image data of the target image.

Figures 9, 10:
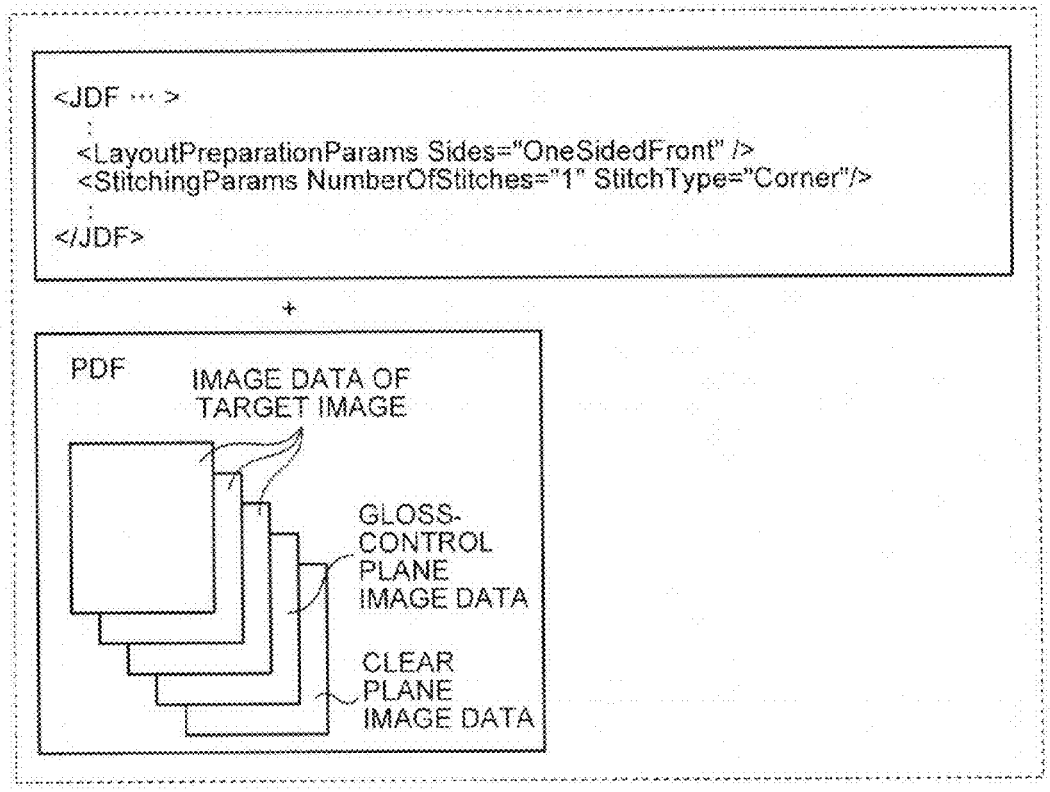
FIG. 9 is a schematic of an example of a density value selection table.
FIG. 10 is a conceptual schematic of an exemplary structure of print data.

The storage unit 12 stores therein the density value selection table storing therein the type of a surface effect specified by the user and the density value of the gloss-control plane corresponding to the type of the surface effect. FIG. 9 is a schematic of an example of the density value selection table. In the example of FIG. 9, the density value of the gloss-control plane corresponding to an area for which the surface effect "PG" (premium gloss) is specified by the user is "98%", the density value of the gloss-control plane corresponding to an area for which "G" (gloss) is specified is "90%", the density value of the gloss-control plane corresponding to an area for which "M" (matte) is specified is "16%", and the density value of the gloss-control plane corresponding to an area for which "PM" (premium matte) is specified is "6%".

The density value selection table is a part of data of a surface effect selection table (described later) stored in the DFE 50. The control unit 15 acquires the surface effect selection table at a predetermined timing to generate the density value selection table from the surface effect selection table thus acquired and stores the density value selection table in the storage unit 12. The surface effect selection table may be stored in a storage server (cloud) on a network, such as the Internet. In this case, the control unit 15 acquires the surface effect selection table from the server and generates the density value selection table from the surface effect selection table thus acquired. The surface effect selection table stored in the DFE 50 needs to be the same as the surface effect selection table stored in the storage unit 12.

Referring back to FIG. 6, the plane data generating unit 122 sets the density value (gloss-control value) of a drawn object for which a certain surface effect is specified by the user to a value corresponding to the type of the surface effect while referring to the density value selection table illustrated in FIG. 9, thereby generating image data of the gloss-control plane. An assumption is made that the user specifies to apply "PG" to the area displayed as "ABC", apply "G" to the area of the rectangular figure, and apply "M" to the area of the circular figure among the target images serving as the image data of the color plane illustrated in FIG. 2, for example. In this case, the plane data generating unit 122 sets the density value of the drawn object for which "PG" is specified by the user ("ABC") to "98%", sets the density value of the drawn object for which "G" is specified ("the rectangular figure") to "90%", and sets the density value of the drawn object for which "M" is specified ("the circular figure") to "16%", thereby generating image data of the gloss-control plane. The image data of the gloss-control plane generated by the plane data generating unit 122 is data in a vector format represented as a set of drawn objects indicating coordinates of points, parameters of equations of lines and planes connecting the points, fill, and special effects, for example. FIG. 4 is a schematic illustrating the image data of the gloss-control plane as an image. The plane data generating unit 122 generates document data by integrating the image data of the gloss-control plane, the image data of the target image (image data of the color plane), and the image data of the clear plane and transmits the document data to the print data generating unit 123.

The print data generating unit 123 generates print data based on the document data. The print data includes the image data of the target image (image data of the color plane), the image data of the gloss-control plane, the image data of the clear plane, and a job command, such as setting of a printer, setting for intensive printing, and setting for duplex printing, issued to the printer. FIG. 10 is a conceptual schematic of an exemplary structure of the print data. While job definition format (JDF) is used as a job command in the example of FIG. 10, the job command is not limited thereto. The JDF illustrated in FIG. 10 is a command for specifying "single-sided printing and stapling" as the setting for intensive printing. The print data may be converted into a page description language (PDL), such as PostScript, or may remain in the PDF as long as the DFE 50 is compatible with the PDF.

Figure 11:
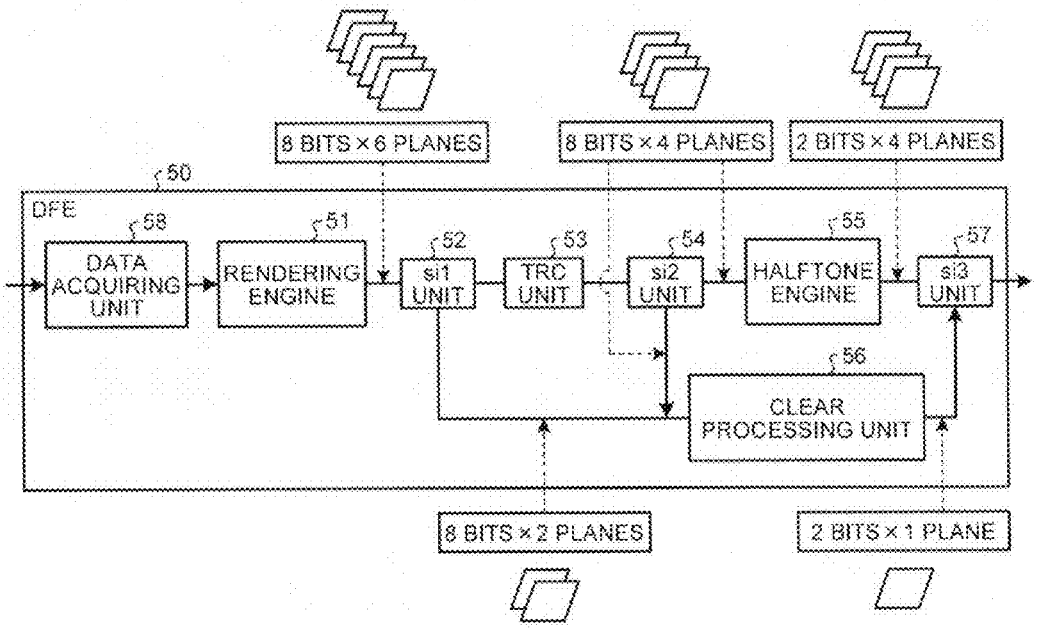
FIG. 11 is an exemplary block diagram of a functional configuration of a DFE.

The functional configuration of the DFE 50 will now be described. As illustrated in FIG. 11, the DFE 50 includes a data acquiring unit 58, a rendering engine 51, an si1 unit 52, a tone reproduction curve (TRC) unit 53, an si2 unit 54, a halftone engine 55, a clear processing unit 56, an si3 unit 57, and the surface effect selection table (not illustrated).

The data acquiring unit 58 acquires image data (e.g. the print data illustrated in FIG. 10) transmitted from the host device 10. In other words, the image data acquired by the data acquiring unit 58 includes gloss-control plane data.

The rendering engine 51, the si1 unit 52, the TRC unit 53, the si2 unit 54, the halftone engine 55, the clear processing unit 56, and the si3 unit 57 are executed by a control unit of the DFE 50 executing various computer programs stored in a main memory or an auxiliary memory. The si1 unit 52, the si2 unit 54, and the si3 unit 57 have a function to separate image data and a function to integrate image data. The surface effect selection table is stored in the auxiliary memory, for example.

The rendering engine 51 receives image data transmitted from the host device 10 via the data acquiring unit 58. The rendering engine 51 interprets the language of the image data thus received to convert the image data expressed in a vector format into image data expressed in a raster format and converts a color space expressed in an RGB format or the like into a color space in a CMYK format. As a result, the rendering engine 51 outputs pieces of 8-bit image data of CMYK color planes, an 8-bit gloss-control plane, and an 8-bit clear plane. The rendering engine 51 may output no clear plane.

The si1 unit 52 outputs the pieces of 8-bit image data of CMYK to the TRC unit 53 and outputs the 8-bit gloss-control plane (and the 8-bit clear plane) to the clear processing unit 56. The DFE 50 converts image data of the gloss-control plane in a vector format received from the host device 10 into image data in a raster format. As a result, the DFE 50 sets the type of the surface effect for the drawn object specified by the user via the image processing application as a density value in pixel units, thereby outputting image data of the gloss-control plane.

The TRC unit 53 receives the pieces of 8-bit image data of CMYK via the si1 unit 52. The TRC unit 53 performs gamma correction on the image data thus received using a gamma curve of 1D_LUT (one-dimensional look-up table) generated by calibration. Examples of the image processing include control on the total amount of toner besides the gamma correction. The total amount control is processing for limiting the pieces of 8-bit image data of CMYK on which the gamma correction is performed for the reason of limits on the amount of toner capable of being supplied by the printer 70 to one pixel on a recording medium. If an image is printed in disregard of the total amount control, the image quality deteriorates because of poor transfer and poor fixing. In the present embodiment, the explanation is made of the related gamma correction alone.

The si2 unit 54 outputs the pieces of 8-bit image data of CMYK on which the gamma correction is performed by the TRC unit 53 to the clear processing unit 56 as data used for generating an inverse mask (which will be described later). The halftone engine 55 receives the pieces of 8-bit image data of CMYK on which the gamma correction is performed via the si2 unit 54. To output the pieces of image data thus received to the printer 70, the halftone engine 55 performs halftone processing for converting the pieces of image data into pieces of 2-bit image data of CMYK, for example. The halftone engine 55 then outputs the pieces of 2-bit image data of CMYK obtained by performing the halftone processing. The 2-bit data format is given just as an example, and the data format is not limited thereto.

The clear processing unit 56 receives the 8-bit gloss-control plane (and the 8-bit clear plane) converted by the rendering engine 51 via the sit unit 52 and receives the pieces of 8-bit image data of CMYK on which the gamma correction is performed by the TRC unit 53 via the si2 unit 54. The clear processing unit 56 uses the gloss-control plane (and the 8-bit clear plane) thus received and refers to the surface effect selection table, which will be described later, thereby determining the surface effect corresponding to the density value (pixel value) of each pixel constituting the gloss-control plane. In accordance with the determination, the clear processing unit 56 determines whether to turn ON or OFF the glosser 80. In addition, the clear processing unit 56 uses the pieces of 8-bit image data of CMYK thus received to generate an inverse mask or a solid mask as appropriate. Thus, the clear processing unit 56 generates 2-bit image data of the clear-toner plane to which the clear toner is to be adhered as appropriate. Based on the result of determination of the surface effect, the clear processing unit 56 generates and outputs image data of the clear-toner plane to be used in the printer 70 as appropriate. In addition, the clear processing unit 56 outputs ON-OFF information corresponding to "ON" or "OFF" of the glosser 80.

The inverse mask makes the total amount of adhered CMYK toners and an adhered clear toner uniform on pixels constituting a target area to which the surface effect is to be applied. Specifically, the inverse mask is generated by adding all the density values of the pixels constituting the target area in the image data of the CMYK plane and subtracting the value thus added from a predetermined value. The inverse mask, for example, is expressed by Equation (1):

$$Clr=100-(C+M+Y+K) \quad (1)$$

in the case of Clr<0, Clr=0 is satisfied.

In Equation (1), Clr, C, M, Y, and K represent the density rate converted from the density value of each pixel for the clear toner and each toner of C, M, Y, and K, respectively. In other words, by using Equation (1), the total amount of adhered toners obtained by adding the amount of the adhered clear toner to the total amount of the adhered toners of C, M, Y, and K is made 100% for all the pixels constituting the target area to which the surface effect is to be applied. If the total amount of the adhered toners of C, M, Y, and K is equal to or larger than 100%, no clear toner is to be adhered, and the density rate of the clear toner is made 0%. This is because the part where the total amount of the adhered toners of C, M, Y, and K exceeds 100% is made smooth by fixing processing. By making the total amount of the adhered toner on all the pixels constituting the target area to which the surface effect is to be applied equal to or larger than 100% in this manner, it is possible to eliminate unevenness on the surface caused by difference in the total amount of the adhered toner in the target area. As a result, gloss is generated by specular reflection of light. Because some inverse masks are derived from equations other than Equation (1), there can be a plurality of types of inverse masks.

The inverse mask, for example, may cause the clear toner to uniformly adhere to the pixels. In this case, the inverse mask is also referred to as a solid mask and is expressed by Equation (2):

$$Clr=100 \quad (2)$$

Because some of the pixels to which the surface effect is to be applied may be associated with a density rate other than 100%, there can be a plurality of types of solid masks.

Alternatively, the inverse mask may be derived by multiplication of the background exposure rate of each color, for example. In this case, for example, the inverse mask is expressed by Equation (3):

$$Clr=100\times\{(100-C)/100\}\times\{(100-M)/100\}\times\{(100-Y)/100\}\times\{(100-K)/100\} \quad (3)$$

In Equation (3), (100−C)/100 represents the background exposure rate of C, (100−M)/100 represents the background exposure rate of M, (100−Y)/100 represents the background exposure rate of Y, and (100−K)/100 represents the background exposure rate of K.

Still alternatively, the inverse mask may be derived by a method assuming that halftone dots having the largest area ratio achieve the smoothness. In this case, for example, the inverse mask is expressed by Equation (4):

$$Clr=100-\max(C,M,Y,K) \quad (4)$$

In Equation (4), max(C,M,Y,K) indicates that the density value of a color having the largest density value among CMYK is a representative value.

In other words, the inverse mask may be expressed by any one of Equation (1) to Equation (4).

The surface effect selection table indicates correspondence relation between the density values serving as gloss-control values indicating surface effects and the types of the surface effects. In addition, the surface effect selection table indicates correspondence relation among control information related to the post-processing device in accordance with the configuration of the printing control system, the image data of the clear-toner plane used in the printer 70, and the image data of the clear-toner plane used in the post-processing device. While the image forming system can have various configurations, the image forming system according to the present embodiment has a configuration in which the glosser 80 serving as the post-processing device is connected to the printer 70. Therefore, the control information related to the post-processing device in accordance with the configuration of the image forming system corresponds to the ON-OFF information indicating "ON" or "OFF" of the glosser 80.

FIG. 12 is an exemplary schematic of a data structure of the surface effect selection table. The surface effect selection table can indicate the correspondence relation among the control information related to the post-processing device, the image data of the clear-toner plane, the density values, and the types of surface effects for each of different configurations of the printing control system (image forming system). FIG. 12 illustrates a data structure corresponding to the configuration of the printing control system according to the present embodiment. In the correspondence relation between the types of surface effects and the density values illustrated in FIG. 12, the types of surface effects are associated with respective ranges of the density values. Furthermore, the types of surface effects are associated with respective rates of density (density rates) each converted from a value (a representative value) serving as a representative of a range of density values in units of 2%. Specifically, surface effects for providing gloss (premium gloss and gloss) are associated with ranges of density values (from "212" to "255") having a density rate of equal to or larger than 84%. By contrast, a surface effect for suppressing gloss (matte) is associated with ranges of density values (from "23" to "43") having a density rate of equal to or smaller than 16%. Furthermore, surface effects, such as a texture, a background pattern, and a watermark, are associated with ranges of density values having density rates of 20% to 80%.

More specifically, premium gloss (PG) is associated with pixel values of "238" to "255" as the surface effect. In these pixel values, three different types of premium gloss are associated with respective ranges of pixel values of "238" to "242", pixel values of "243" to "247", and pixel values of "248" to "255". Gloss (G) is associated with pixel values of "212" to "232". In these pixel values, four different types of gloss are associated with respective ranges of pixel values of "212" to "216", pixel values of "217" to "221", pixel values of "222" to "227", and pixel values of "228" to "232". Matte (M) is associated with pixel values of "23" to "43". In these pixel values, four different types of matte are associated with respective ranges of pixel values of "23" to "28", pixel values of "29" to "33", pixel values of "34" to "38", and pixel values of "39" to "43". These different types of the same surface effect are different from one another in equations for deriving image data of the clear-toner plane to be used in the printer 70. The printer main body and the post-processing device each perform the same operation. No surface effect is associated with a density value of "0".

In the surface effect selection table (FIG. 12), the pixel values, the surface effects, and the ON-OFF information indicating "ON" or "OFF" of the glosser 80 are associated with one another. The ON-OFF information indicates the optimum post-processing for each surface effect. Specifically, the surface effect selection table indicates that the glosser 80 is turned ON if the surface effect is premium gloss, that the glosser 80 is turned OFF if the surface effect is gloss, tactile pattern, or matte, and that "ON" or "OFF" of the glosser 80 is not specified if the surface effect is user definition, watermark character, or background pattern, or if no surface effect is to be applied.

The clear processing unit 56 refers to the surface effect selection table to determine the surface effect associated with each pixel value indicated by the gloss-control plane. In addition, the clear processing unit 56 determines whether to turn ON or OFF the glosser 80 and determines the type of image data of the clear-toner plane to be used in the printer 70. The clear processing unit 56 determines whether to turn ON or OFF the glosser 80 for each page. Subsequently, as described above, the clear processing unit 56 generates and outputs the image data of the clear-toner plane based on the result of the determination as appropriate. In addition, the clear processing unit 56 outputs the ON-OFF information of the glosser 80.

Figure 13:
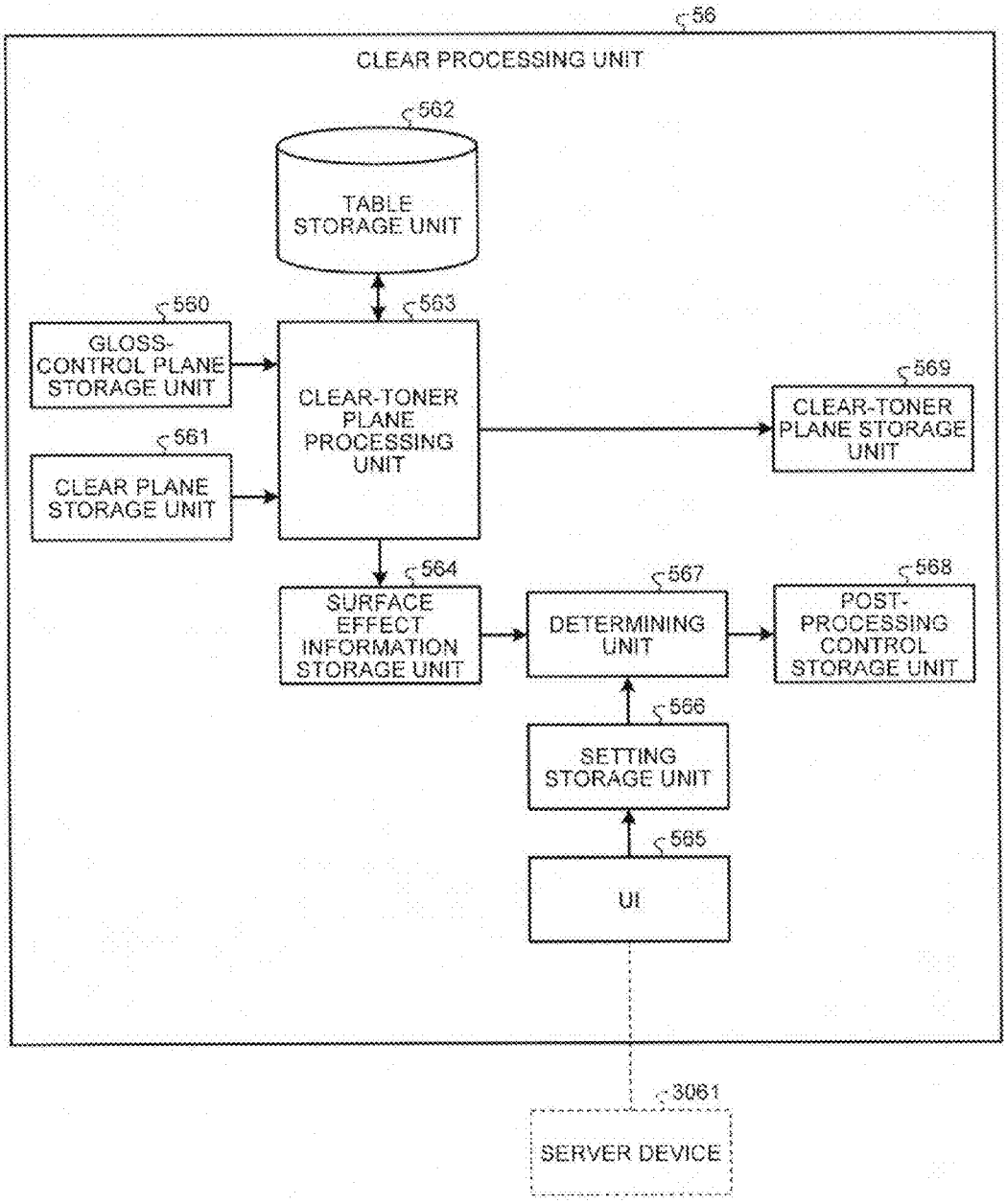
FIG. 13 is an exemplary block diagram of a functional configuration of a clear processing unit.

FIG. 13 illustrates an example of a functional configuration of the clear processing unit 56. A clear-toner plane processing unit 563 performs clear-toner plane processing for generating a clear-toner plane based on gloss-control plane data acquired from a gloss-control plane storage unit 560, clear plane data acquired from a clear plane storage unit 561, and a surface effect table acquired from a table storage unit 562. The clear-toner plane processing unit 563 then stores the result in a clear-toner plane storage unit 569. While performing the clear-toner plane processing, the clear-toner plane processing unit 563 stores information of the surface effect applied to the clear-toner plane in a surface effect information storage unit 564. When the clear-toner plane processing is completed on the whole page, the surface effect information storage unit 564 stores therein all the information of the surface effects applied to the page. Based on the information, a determining unit 567 determines post-processing control.

Because the glosser 80 performs processing in page units, the glosser 80 cannot achieve turning ON and OFF of the processing simultaneously on a single page. Therefore, if there are a plurality of surface effects to be produced by post-processing incapable of being performed simultaneously by the glosser 80 (turning ON and OFF of the processing) in a single page, the determining unit 567 determines post-processing to be preferentially performed by the glosser 80 in page units based on priority information so as to produce the surface effects properly in page units. The priority information indicates which post-processing is to be preferentially performed by the glosser 80 in page units between types of post-processing for which the glosser 80 is turned ON or OFF. Specifically, the priority information is determined in advance so as to produce surface effects properly based on the surface effect selection table (FIG. 12), for example. The priority information includes selection methods of post-processing control, such as "fixed to OFF" for constantly turning OFF the glosser 80, "prioritize ON" for prioritizing a surface effect for which the glosser 80 is turned ON, and "prioritize OFF" for prioritizing a surface effect for which the glosser 80 is turned OFF, for example.

The clear processing unit 56 may include a user interface (UI) 565 and a setting storage unit 566, for example, and receive input for setting the priority information via an input unit included in the UI 565. The setting storage unit 566 stores therein setting of the priority information received via the UI 565. Alternatively, the priority information may be set in the clear processing unit 56 not via the UI 565 but from a server device 3061, for example. Information indicating the results of determination made by the determining unit 567 is stored in a post-processing control storage unit 568.

Figure 14:
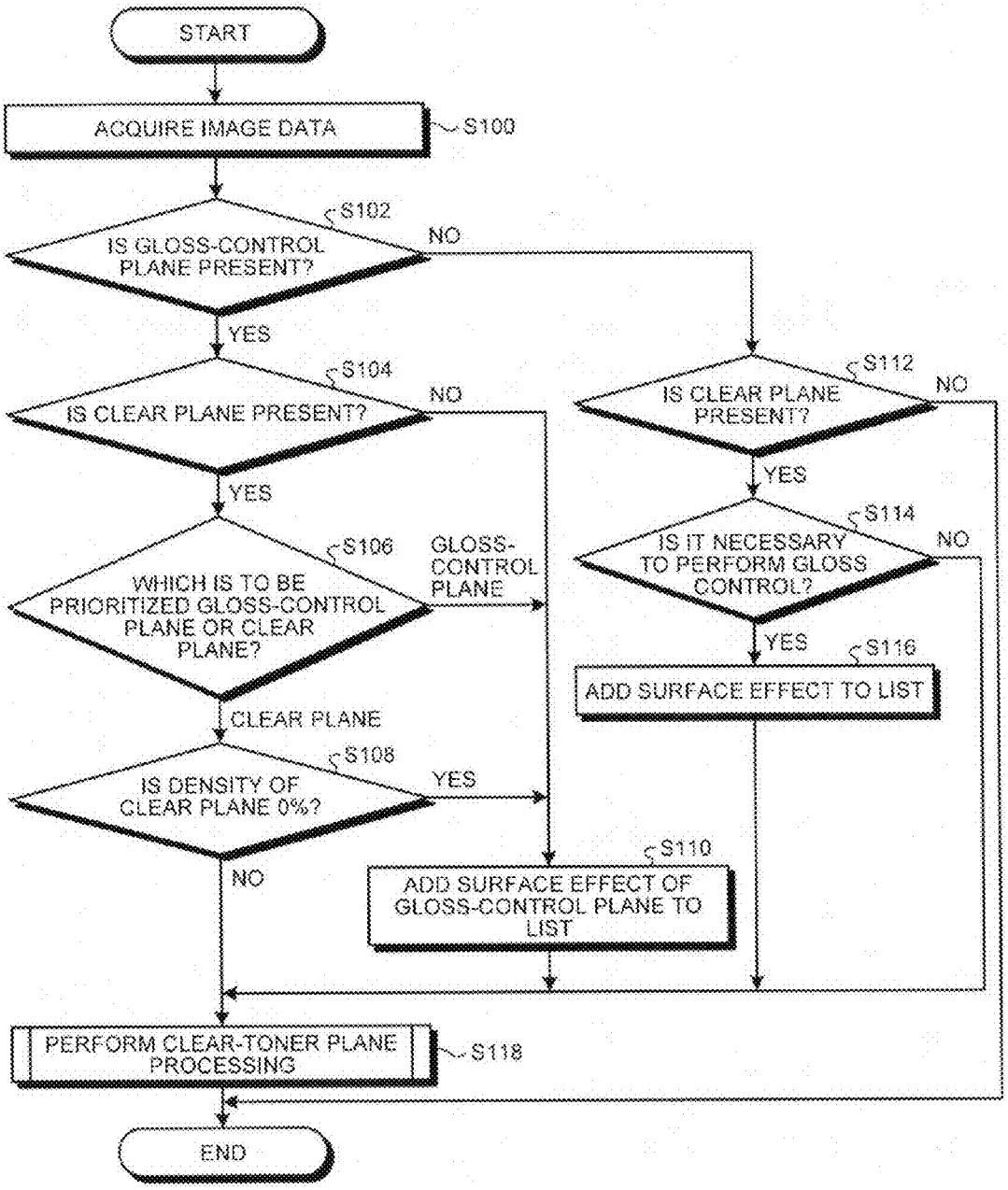
FIG. 14 is a flowchart of an exemplary operation of a clear-toner plane processing unit.

An exemplary operation of the clear processing unit 56 will now be described with an emphasis on operations of the clear-toner plane processing unit 563 and the determining unit 567. FIG. 14 is a flowchart of an exemplary operation of the clear-toner plane processing unit 563. As illustrated in FIG. 14, the clear-toner plane processing unit 563 acquires image data to be transferred onto a recording medium via the data acquiring unit 58 at Step S100.

The clear-toner plane processing unit 563 then determines whether the image data acquired at Step S100 includes a gloss-control plane (gloss-control plane image data) at Step S102. If the clear-toner plane processing unit 563 determines that the image data includes a gloss-control plane (Yes at Step S102), the system control goes to Step S104. By contrast, if the clear-toner plane processing unit 563 determines that the image data includes no gloss-control plane (No at Step S102), the system control goes to Step S112.

The clear-toner plane processing unit 563 determines whether the image data acquired at Step S100 includes a clear plane at Step S104. If the clear-toner plane processing unit 563 determines that the image data includes a clear plane (Yes at Step S104), the system control goes to Step S106. By contrast, if the clear-toner plane processing unit 563 determines that the image data includes no clear plane (No at Step S104), the system control goes to Step S110.

The clear-toner plane processing unit 563 determines whether the gloss-control plane or the clear plane is to be prioritized based on the priority information at Step S106. If the clear-toner plane processing unit 563 determines to prioritize the clear plane, the system control goes to Step S108. By contrast, if the clear-toner plane processing unit 563 determines to prioritize the gloss-control plane, the system control goes to Step S110.

The clear-toner plane processing unit 563 determines whether the density of the clear plane is 0% at Step S108. If the clear-toner plane processing unit 563 determines that the density of the clear plane is 0% (Yes at Step S108), the system control goes to Step S110. By contrast, if the clear-toner plane processing unit 563 determines that the density of the clear plane is not 0% (No at Step S108), the system control goes to Step S118.

The clear-toner plane processing unit 563 adds a surface effect of the gloss-control plane to a list at Step S110. FIG. 15 illustrates an example of a list (results of acquisition of surface effect information) to which the clear-toner plane processing unit 563 adds a surface effect of the gloss-control plane. The list illustrated in FIG. 15 indicates whether the surface effects are present in a single page. The surface effect information acquired by the clear-toner plane processing unit 563 may be formed in another format as long as the surface effect information can determine whether each of the surface effects is present. The list to which the clear-toner plane processing unit 563 adds a surface effect may list the surface effects that are present or may be a list in which the number of dots counted for each surface effect is associated with each surface effect.

The clear-toner plane processing unit 563 determines whether the image data acquired at Step S100 includes a clear plane at Step S112. If the clear-toner plane processing unit 563 determines that the image data includes a clear plane (Yes at Step S112), the system control goes to Step S114. By contrast, if the clear-toner plane processing unit 563 determines that the image data includes no clear plane (No at Step S112), the processing is terminated.

The clear-toner plane processing unit 563 determines whether it is necessary to perform gloss-control using the clear plane based on settings made by the user at Step S114. If the clear-toner plane processing unit 563 determines that it is necessary to perform gloss-control (Yes at Step S114), the system control goes to Step S116. By contrast, if the clear-toner plane processing unit 563 determines that it is not necessary to perform gloss-control (No at Step S114), the system control goes to Step S118.

The clear-toner plane processing unit 563 adds a surface effect to be applied using the clear plane to the list illustrated in FIG. 15 at Step S116.

The clear-toner plane processing unit 563 then refers to the list illustrated in FIG. 15 and performs clear-toner plane processing for generating a clear-toner plane of each pixel that produces surface effects properly at Step S118.

Figure 16:
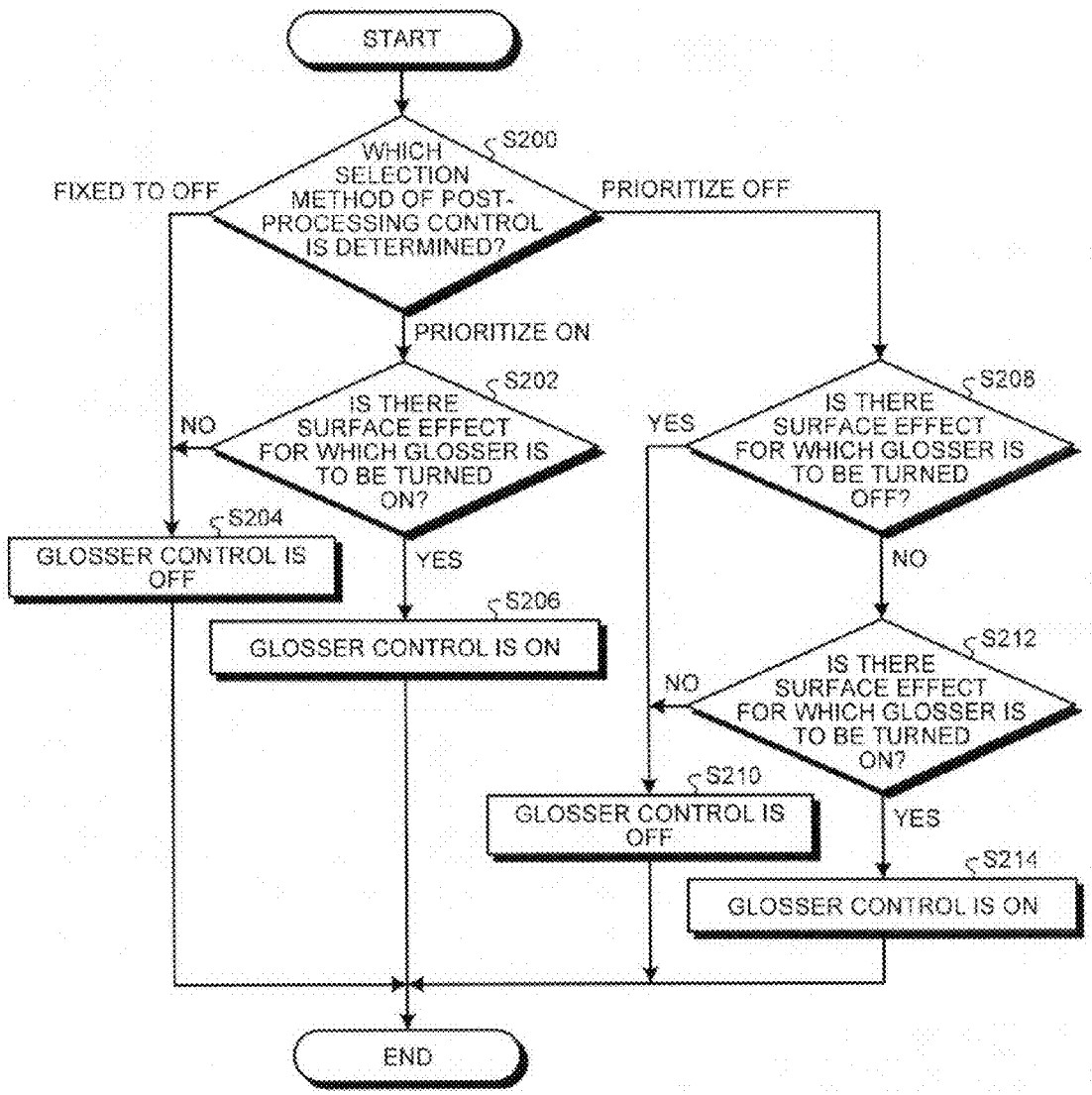
FIG. 16 is a flowchart of an exemplary operation of a determining unit.

FIG. 16 is a flowchart of an exemplary operation of the determining unit 567. As illustrated in FIG. 16, the determining unit 567 determines a selection method of post-processing control included in the priority information at Step S200. If the determining unit 567 determines that the selection method is "prioritize ON", the system control goes to Step S202. If the determining unit 567 determines that the selection method is "prioritize OFF", the system control goes to Step S208. If the determining unit 567 determines that the selection method is "fixed to OFF", the system control goes to Step S204.

The determining unit 567 determines whether there is a surface effect for which the glosser 80 is to be turned ON in a single page (refer to FIG. 12) at Step S202. If the determining unit 567 determines that there is a surface effect for which the glosser 80 is to be turned ON (Yes at Step S202), the system control goes to Step S206. By contrast, if the determining unit 567 determines that there is no surface effect for which the glosser 80 is to be turned ON (No at Step S202), the system control goes to Step S204.

The determining unit 567 determines to turn OFF the glosser 80 at Step S204. In other words, the determining unit 567 determines to preferentially perform post-processing for which the glosser 80 is turned OFF in page units (glosser control is OFF).

The determining unit 567 determines to turn ON the glosser 80 at Step S206. In other words, the determining unit 567 determines to preferentially perform post-processing for which the glosser 80 is turned ON in page units (the glosser control is ON).

The determining unit 567 determines whether there is a surface effect for which the glosser 80 is to be turned OFF in the single page (refer to FIG. 12) at Step S208. If the determining unit 567 determines that there is a surface effect for which the glosser 80 is to be turned OFF (Yes at Step S208), the system control goes to Step S210. By contrast, if the determining unit 567 determines that there is no surface effect for which the glosser 80 is to be turned OFF (No at Step S208), the system control goes to Step S212.

The determining unit 567 determines to turn OFF the glosser 80 at Step S210. In other words, the determining unit 567 determines to preferentially perform post-processing for which the glosser 80 is turned OFF in page units (the glosser control is OFF).

The determining unit 567 determines whether there is a surface effect for which the glosser 80 is to be turned ON in the single page at Step S212. If the determining unit 567 determines that there is a surface effect for which the glosser 80 is to be turned ON (Yes at Step S212), the system control goes to Step S214. By contrast, if the determining unit 567 determines that there is no surface effect for which the glosser 80 is to be turned ON (No at Step S212), the system control goes to Step S210.

The determining unit 567 determines to turn ON the glosser 80 at Step S214. In other words, the determining unit 567 determines to preferentially perform post-processing for which the glosser 80 is turned ON in page units (the glosser control is ON).

The si3 unit 57 (FIG. 11) integrates the pieces of 2-bit image data of CMYK on which the halftone processing is performed and the 2-bit image data of the clear-toner plane generated by the clear processing unit 56 and outputs the image data thus integrated to the MIC 60. If the clear processing unit 56 generates no image data of the clear-toner plane to be used in the printer 70, the si3 unit 57 outputs image data obtained by integrating the pieces of 2-bit image data of CMYK. As a result, the DFE 50 outputs four or five pieces of 2-bit image data to the MIC 60. The si3 unit 57 also outputs the ON-OFF information of the glosser 80 received from the clear processing unit 56 to the MIC 60.

Figure 17:
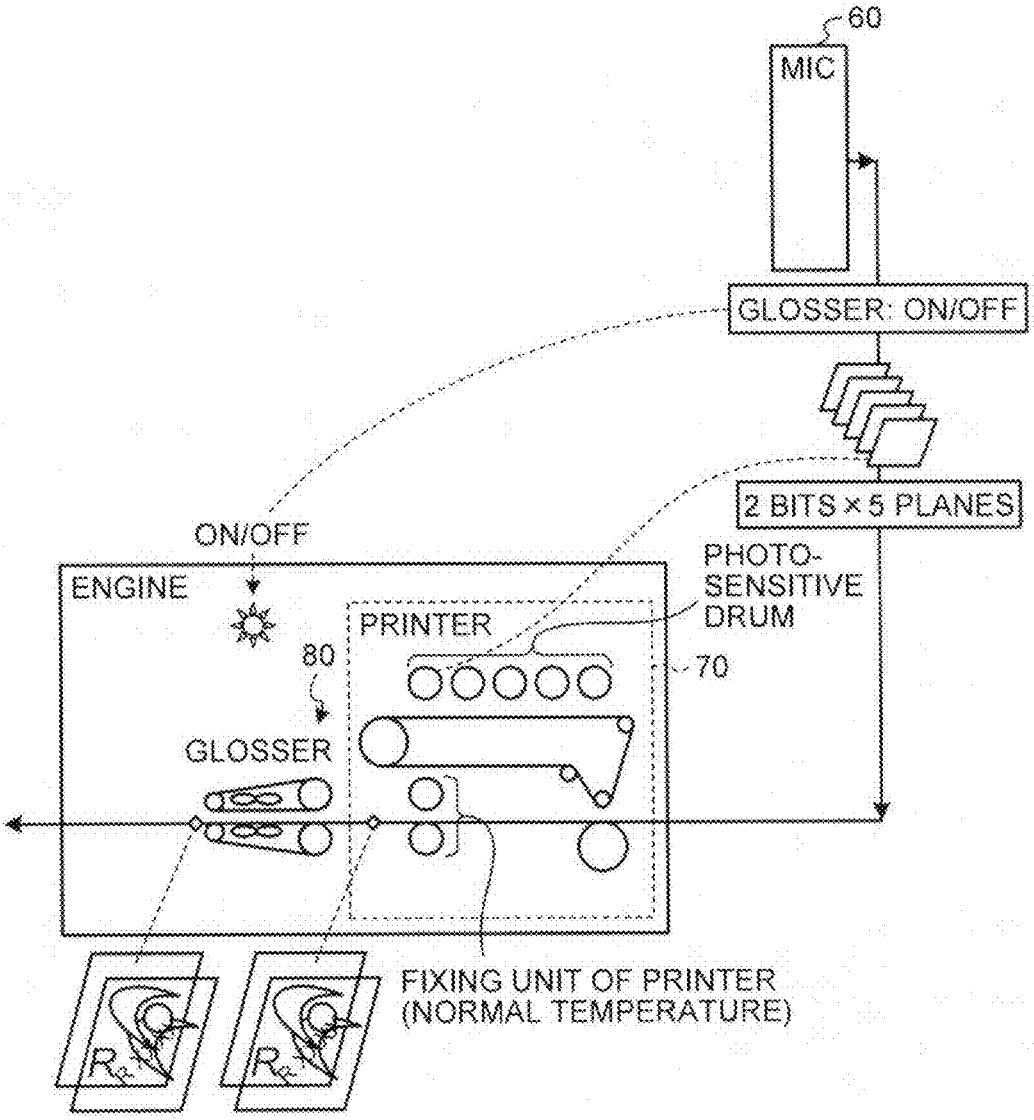
FIG. 17 is an exemplary conceptual schematic of a configuration of an MIC.

The MIC 60 (FIG. 1) is connected to the DFE 50 and the printer 70. The MIC 60 outputs device configuration information indicating the configuration of the device provided as the post-processing device to the DFF 50. The MIC 60 receives pieces of image data of the color planes and pieces of image data of the clear-toner planes from the DFE 50. The MIC 60 then sorts the pieces of image data into devices corresponding thereto and controls the post-processing device. More specifically, as illustrated in FIG. 17, the MIC 60 outputs the pieces of image data of the CMYK color planes among the pieces of image data output from the DFE 50 to the printer 70. If there is image data of the clear-toner plane to be used in the printer 70, the MIC 60 also outputs the image data of the clear-toner plane to the printer 70. In addition, the MIC 60 uses the ON-OFF information received from the DFE 50 to turn ON or OFF the glosser 80. The glosser 80 may be switched between a path for performing fixing and a path for performing no fixing based on the ON-OFF information.

As illustrated in FIG. 17, a printing system formed of the printer 70 and the glosser 80 includes a conveying path for conveying a recording medium. Specifically, the printer 70 includes a plurality of electrophotography photosensitive drums, a transfer belt onto which a toner image formed on the photosensitive drums is transferred, a transfer device that transfers a toner image on the transfer belt onto a recording medium, and a fixing unit that fixes a toner image on a recording medium to the recording medium. The recording medium is conveyed by a conveying member, which is not illustrated, to the printer 70 and the glosser 80 in this order through the conveying path. After these devices sequentially perform processing on the recording medium to form an image and apply a surface effect thereto, the recording medium is conveyed by a conveying mechanism, which is not illustrated, through the conveying path and is ejected outside of the printing system.

Figure 18:
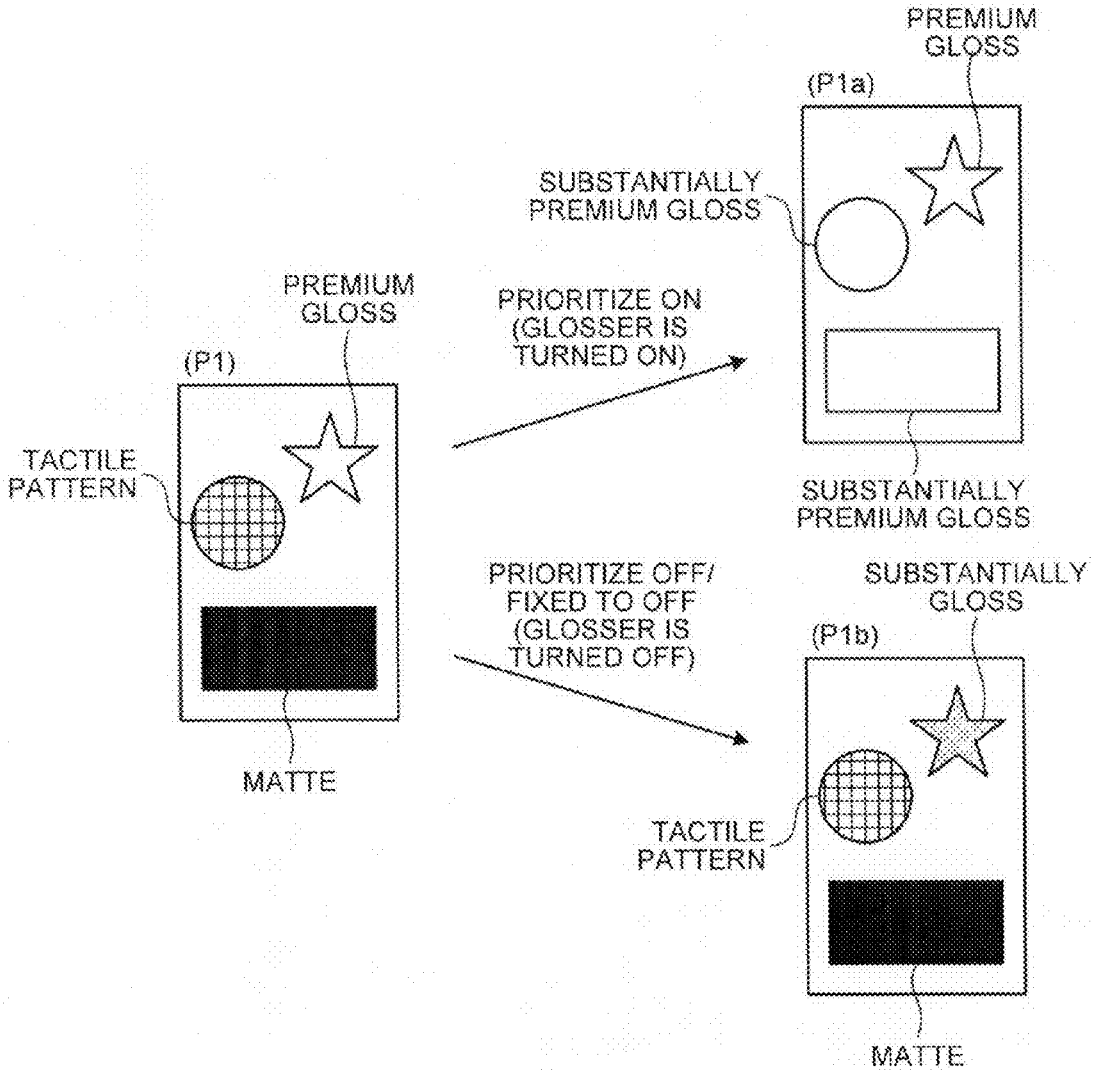
FIG. 18 is a schematic of results of printing performed by the printing control system when gloss-control plane data indicates a plurality of types of post-processing incapable of being performed simultaneously by a glosser in one page.

FIG. 18 is a schematic of results of printing performed by the printing control system according to the present embodiment when gloss-control plane data indicates a plurality of types of post-processing incapable of being performed simultaneously by the glosser 80 in page units. As illustrated in FIG. 18, if the DFE 50 receives image data including gloss-control plane data P1 indicating post-processing of premium gloss, tactile pattern, and matte, the printing control system outputs a print result P1*a* and a print result P1*b*, for example. In other words, if the selection method of the post-processing control is "prioritize ON", the printing control system performs post-processing for which the glosser 80 is turned ON in accordance with the surface effect selection table illustrated in FIG. 12 to output the print result P1*a*. In the print result P1*a*, the post-processing corresponding to tactile pattern and matte in the gloss-control plane data P1 is replaced by post-processing corresponding to premium gloss. By contrast, if the selection method of the post-processing control is "prioritize OFF" or "fixed to OFF", the printing control system performs post-processing for which the glosser 80 is turned OFF to output the print result P1*b*. In the print result P1*b*, the post-processing corresponding to tactile pattern and matte in the gloss-control plane data P1 is performed without any change, whereas the post-processing corresponding to premium gloss in the gloss-control plane data P1 is replaced by post-processing corresponding to gloss.

A change in the surface effect selection table will now be described. The surface effect selection table illustrated in FIG. 12 is determined in advance and stores therein an operation (ON or OFF) of the glosser 80 in a manner associated with each of the surface effects. The surface effect selection table may be changed via the UI 565, for example. FIG. 19 is a schematic of a menu screen used for changing the surface effect selection table displayed by the UI 565, for example. As illustrated in FIG. 19, turning ON or OFF of the glosser (the rightmost column in FIG. 12) in the surface effect selection table may be changed via the menu screen. The surface effect selection table may be changed for each surface effect or each group, such as premium gloss and gloss. As described above, the printing system uses the surface effect selection table capable of being changed and specifies the selection method of the post-processing control, thereby making it possible to change the surface effects.

Second Embodiment

In the first embodiment, the host device 10 includes the plane data generating unit 122 and the print data generating unit 123, and the DFE 50 includes the clear processing unit 56. The host device 10 performs plane data generation processing for generating color plane data, clear plane data, and gloss-control plane data and generation processing of print data. The DFE 50 performs generation processing of clear-toner plane data. The configuration of the printing system, however, is not limited thereto.

In other words, any one of a plurality of types of processing performed by a single device may be performed by one or more other devices connected to the single device via a network.

In a printing control system (an image forming system) according to a second embodiment of the present invention, for example, a part of functions of a host device and a DFE is provided to a server device on a network.

Figure 20:
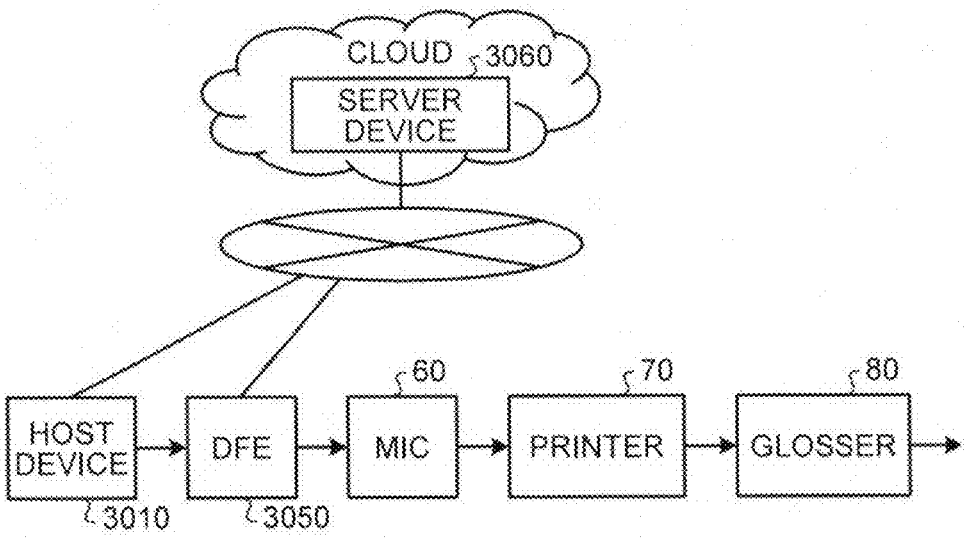
FIG. 20 is an exemplary block diagram of a configuration of a printing control system according to a second embodiment of the present invention.

FIG. 20 is an exemplary block diagram of a configuration of the printing control system according to the second embodiment. As illustrated in FIG. 20, the printing control system includes a host device 3010, a DFE 3050, an MIC 60, a printer 70, a glosser 80, and a server device 3060 on a cloud. The post-processing device, such as the glosser 80, is not limited thereto.

In the present embodiment, the host device 3010 and the DFE 3050 are connected to the server device 3060 via a network, such as the Internet. Furthermore, in the present embodiment, the plane data generating unit and the print data generating unit of the host device 10 in the first embodiment and the clear processing unit of the DFE 50 in the first embodiment are provided to the server device 3060.

The connection configuration of the host device 3010, the DFE 3050, the MIC 60, the printer 70, and the glosser 80 is the same as that in the first embodiment.

Specifically, in the second embodiment, the host device 3010 and the DFE 3050 are connected to the single server device 3060 via a network (cloud), such as the Internet, for example. The server device 3060 performs the plane data generation processing for generating color plane data, clear plane data, and gloss-control plane data, the generation processing of print data, and the generation processing of clear-toner plane data.

Figure 21:
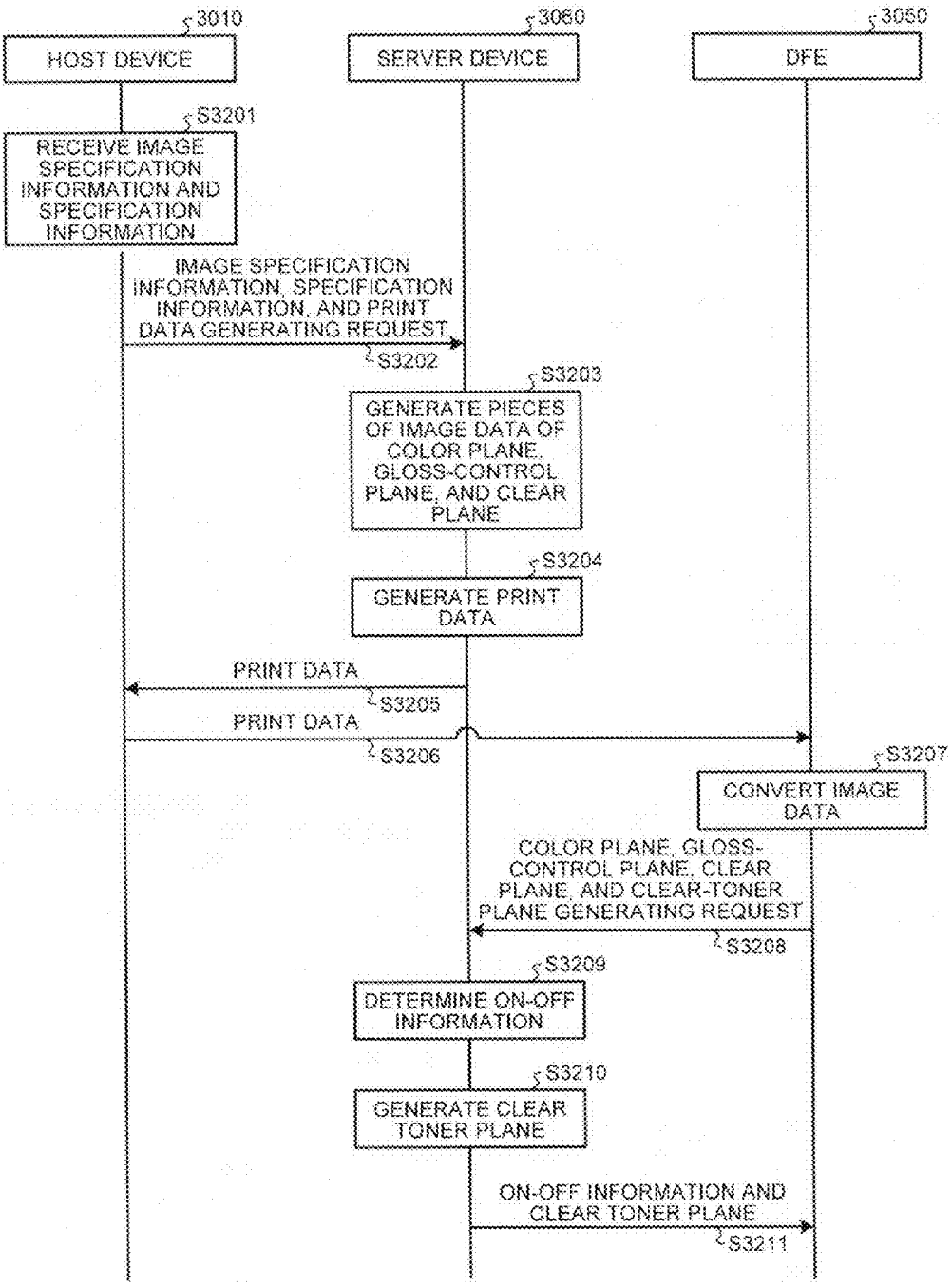
FIG. 21 is a sequence diagram of the whole process of generation processing of a clear toner plane according to the second embodiment.

An explanation will be made of the generation processing of a clear-toner plane required for printing performed by the printing control system according to the second embodiment. The whole process of the generation processing of a clear toner plane will now be described. FIG. 21 is a sequence diagram of the whole process of the generation processing of a clear toner plane according to the second embodiment.

The host device 3010 receives image specification information and specification information from the user (Step S3201). The host device 3010 then transmits a print data generating request together with the image specification information and the specification information to the server device 3060 (Step S3202).

The server device 3060 receives the print data generating request together with the image specification information and the specification information and generates image data of the color plane, image data of the gloss-control plane, and image data of the clear plane (Step S3203). The server device 3060 then generates print data from the pieces of image data (Step S3204) and transmits the print data thus generated to the host device 3010 (Step S3205).

If the host device 3010 receives the print data, the host device 3010 transmits the print data to the DFE 3050 (Step S3206).

If the DFE 3050 receives the print data from the host device 3010, the DFE 3050 analyzes the print data to obtain image data of the color plane, image data of the gloss-control plane, and image data of the clear plane. The DFE 3050 then performs conversion, correction, and other processing on the pieces of image data (Step S3207). The DFE 3050 then transmits the image data of the color plane, the image data of the gloss-control plane, the image data of the clear plane, and a clear-toner plane generating request to the server device 3060 (Step S3208).

If the server device 3060 receives the image data of the color plane, the image data of the gloss-control plane, the image data of the clear plane, and the clear-toner plane generating request, the server device 3060 determines ON-OFF information (Step S3209) and generates image data of a clear toner plane (Step S3210). The server device 3060 then transmits the ON-OFF information and the image data of the clear toner plane thus generated to the DFE 3050 (Step S3211).

As described above, the server device 3060 on the cloud generates image data of the color plane, image data of the gloss-control plane, image data of the clear plane, print data, and image data of the clear toner plane in the second embodiment. As a result, even if there are a plurality of host devices 3010 and DFEs 3050, it is possible to collectively change the density value selection table and the surface effect selection table, for example, besides to enjoy the advantageous effects of the first embodiment. This is convenient for an administrator.

While the single server device 3060 on the cloud performs plane data generation processing for generating color plane data, clear plane data, and gloss-control plane data, generation processing of print data, and generation processing of clear toner plane data in the second embodiment, the configuration is not limited thereto.

Two or more server devices may be provided on the cloud, and the processing described above may be distributed to and performed by the two or more server devices, for example.

Figure 22:
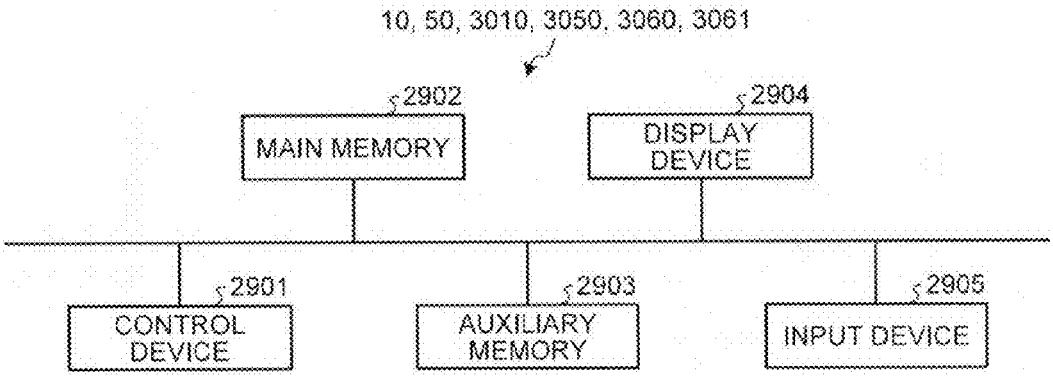
FIG. 22 is a block diagram of a hardware configuration of the host device, the DFE, and a server device.

The hardware configuration of the host devices 10 and 3010, the DFEs 50 and 3050, and the server devices 3060 and 3061 will now be described. FIG. 22 is a block diagram of the hardware configuration of the host devices 10 and 3010, the DFEs 50 and 3050, and the server devices 3060 and 3061. The host devices 10 and 3010, the DFEs 50 and 3050, and the server devices 3060 and 3061 have a hardware configuration using a typical computer. The hardware configuration mainly includes a control device 2901 such as a CPU, a main memory 2902 such as a ROM and a RAM, an auxiliary memory 2903 such as an HDD, an input device 2905 such as a keyboard and a mouse, and a display device 2904 such as a display. The control device 2901 collectively controls each device. The main memory 2902 stores therein various types of data and computer programs. The auxiliary memory 2903 stores therein various types of data and computer programs.

An image processing program (including an image processing application; the same shall apply hereinafter) executed in the host devices 10 and 3010 is provided as a computer program product in a manner recorded in a computer-readable storage medium, such as a compact disk read-only memory (CD-ROM), a flexible disk (FD), a compact disk recordable (CD-R), and a digital versatile disk (DVD), as a file in an installable or executable format.

The image processing program executed in the host devices 10 and 3010 may be provided in a manner stored in a computer connected to a network such as the Internet to be made available for downloads via the network. Furthermore, the image processing program executed in the host devices 10 and 3010 according to the embodiments may be provided or distributed over a network such as the Internet.

The image processing program executed in the host devices 10 and 3010 may be provided in a manner incorporated in advance in a ROM or the like.

The image processing program executed in the host devices 10 and 3010 has a module configuration including each unit described above (the image processing unit, the plane data generating unit, the print data generating unit, the input control unit, and the display control unit). In actual hardware, the CPU (processor) reads and executes the image processing program from the storage medium described above to load each unit on the main memory. Thus, the image processing unit, the plane data generating unit, the print data generating unit, the input control unit, and the display control unit are generated on the main memory.

The printing control processing performed by the DFEs 50 and 3050 may be executed by a printing control program serving as software besides by hardware. In this case, the printing control program executed in the DFEs 50 and 3050 according to the embodiments is provided in a manner incorporated in advance in a ROM or the like.

The printing control program executed in the DFEs 50 and 3050 may be provided as a computer program product in a manner recorded in a computer-readable storage medium, such as a CD-ROM, an FD, a CD-R, and a DVD, as a file in an installable or executable format.

The printing control program executed in the DFEs 50 and 3050 may be provided in a manner stored in a computer connected to a network such as the Internet to be made available for downloads via the network. Furthermore, the printing control program executed in the DFE 50 according to the embodiments may be provided or distributed over a network such as the Internet.

The printing control program executed in the DFEs 50 and 3050 has a module configuration including each unit described above (the rendering engine, the halftone engine, the TRC, the si1 unit, the si2 unit, the si3 unit, and the clear processing unit). In actual hardware, the CPU (processor) reads and executes the printing control program from the ROM to load each unit on the main memory. Thus, the rendering engine, the halftone engine, the TRC, the si1 unit, the si2 unit, the si3 unit, and the clear processing unit are generated on the main memory.

The generation processing of each data performed by the server devices 3060 and 3061 may be executed by a generation program serving as software besides by hardware. In this case, the generation program executed in the server devices 3060 and 3061 according to the embodiments is provided in a manner incorporated in advance in a ROM or the like.

The generation processing program of each data executed in the server devices 3060 and 3061 may be provided as a computer program product in a manner recorded in a computer-readable storage medium, such as a CD-ROM, an FD, a CD-R, and a DVD, as a file in an installable or executable format.

The generation processing program of each data executed in the server devices 3060 and 3061 may be provided in a manner stored in a computer connected to a network such as the Internet to be made available for downloads via the network. Furthermore, the generation processing program of each data executed in the server devices 3060 and 3061 according to the embodiments may be provided or distributed over a network such as the Internet.

The generation processing program of each data executed in the server devices 3060 and 3061 has a module configuration including each unit described above (the plane data generating unit, the print data generating unit, and the clear processing unit). In actual hardware, the CPU (processor) reads and executes the generation program from the ROM to load each unit on the main memory. Thus, the plane data generating unit, the print data generating unit, and the clear processing unit are generated on the main memory.

While the image forming systems according to the embodiments include the host devices 10 and 3010, the DFEs 50 and 3050, the MIC 60, the printer 70, and the glosser 80, the configuration is not limited thereto. The DFEs 50 and 3050, the MIC 60, and the printer 70 may be integrated as one image forming apparatus, for example. Furthermore, these devices may be formed as an image forming apparatus further including the glosser 80.

While the image forming systems according to the embodiments form an image with a plurality of color toners of CMYK, the image forming systems may form an image with one color toner.

While the printer systems according to the embodiments include the MIC 60, the configuration is not limited thereto. The configuration may not include the MIC 60 by shifting the processing performed by the MIC 60 and the function of the MIC 60 to other devices, such as the DFE 50.

According to the embodiments, it is possible to accept a print request including a plurality of surface effects to be produced by a plurality of types of post-processing incapable of being performed simultaneously by a post-processing device in a single page and control the post-processing device so as to produce the surface effects properly.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A printing control device comprising:

a data acquiring unit configured to acquire gloss-control plane data that indicates a plurality of types of surface effects to be applied during post-processing of one page of a recording medium and areas to which the respective types of surface effects are to be applied in the one page of the recording medium, the types of surface effects including at least one type of surface effect that requires a post-processing device to be on during post-processing of the one page and including at least one type of surface effect that requires the post-processing device to be off during post-processing of the one page;

a determining unit configured to determine whether the post-processing device is to be turned on or off during post-processing of the one page, based on priority information that selects only one between the at least one type of surface effect that requires a post-processing device to be on and the at least one type of surface effect that requires the post-processing device to be off indicated in the gloss-control plane data of the one page; and a control unit configured to perform one of controlling the post-processing device to be on during post-processing of the one page, controlling application of indicated surface effects that require the post-processing device to be on during post-processing of the one page, and controlling inhibition of indicated surface effects that require the post-processing device to be off during post-processing of the one page, or controlling the post-processing device to be off during post-processing of the one page, controlling application of indicated surface effects that require the post-processing device to be off during post-processing of the one page, and controlling inhibition of indicated surface effects that require the post-processing device to be on during post-processing of the one page.

2. The printing control device according to claim 1, further comprising an input unit configured to receive input for setting the priority information.

3. The printing control device according to claim 1, wherein the post-processing device is a glosser that performs post-processing for controlling gloss on the recording medium.

4. The printing control device according to claim 1, wherein the priority information indicates whether the post-processing device is to always be off, whether types of surface effects that require the post-processing device to be on are to be prioritized, or whether types of surface effects that require the post-processing device to be off are to be prioritized.

5. A printing control method comprising:

acquiring gloss-control plane data that indicates a plurality of types of surface effects to be applied during post-processing of one page of a recording medium and areas to which the respective types of surface effects are to be applied in the one page of the recording medium, the types of surface effects including at least one type of surface effect that requires a post-processing device to be on during post-processing of the one page and including at least one type of surface effect that requires the post-processing device to be off during post-processing of the one page;

determining whether the post-processing device is to be turned on or off during post-processing of the one page, based on priority information that selects only one between the at least one type of surface effect that requires a post-processing device to be on and the at least one type of surface effect that requires the post-processing device to be off indicated in the gloss-control plane data of the one page; and performing one of controlling the post-processing device to be on during post-processing of the one page, controlling application of indicated surface effects that require the post-processing device to be on during post-processing of the one page, and controlling inhibition of indicated surface effects that require the post-processing device to be off during post-processing of the one page, or controlling the post-processing device to be off during post-processing device to be off one page, controlling application of indicated surface effects that require the post-processing device to be off during post-processing of the one page, and controlling inhibition of indicated surface effects that require the post-processing device to be on during post-processing of the one page.

6. The printing control method according to claim 5, wherein the priority information indicates whether the post-processing device is to always be off, whether types of surface effects that require the post-processing device to be on are to be prioritized, or whether types of surface effects that require the post-processing device to be off are to be prioritized.

7. A non-transitory computer-readable storage medium with an executable program stored thereon, wherein the program instructs a computer to perform:

acquiring gloss-control plane data that indicates a plurality of types of surface effects to be applied during post-processing of one page of a recording medium and areas to which the respective types of surface effects are to be applied in the one page of the recording medium, the types of surface effects including at least one type of surface effect that requires a post-processing device to be on during post-processing of the one page and including at least one type of surface effect that requires the post-processing device to be off during post-processing of the one page;

determining whether the post-processing device is to be turned on or off during post-processing of the one page, based on priority information that selects only one between the at least one type of surface effect that requires a post-processing device to be on and the at least one type of surface effect that requires the post-processing device to be off indicated in the gloss-control plane data of the one page; and performing one of controlling the post-processing device to be on during post-processing of the one page, controlling application of indicated surface effects that require the post-processing device to be on during post-processing of the one page controlling inhibition of indicated surface effects that require the post-processing device to be off during post-processing of the one page, or controlling the post-processing device to be off during post-processing of the one page, controlling application of indicated surface effects that require the post-processing device to be off during post-processing of the one page, and controlling inhibition of indicated surface effects that require the post-processing device to be on during post-processing of the one page.

8. The non-transitory computer-readable storage medium according to claim 7, wherein the priority information indicates whether the post-processing device is to always be off, whether types of surface effects that require the post-processing device to be on are to be prioritized, or whether types of surface effects that require the post-processing device to be off are to be prioritized.

* * * * *